US005185599A

United States Patent [19]

Doornink et al.

[11] Patent Number: 5,185,599

[45] Date of Patent: Feb. 9, 1993

[54] LOCAL DISPLAY BUS ARCHITECTURE AND COMMUNICATIONS METHOD FOR RASTER DISPLAY

[75] Inventors: Douglas J. Doornink, Portland; David L. Knierim, Wilsonville; John C. Dalrymple, Portland, all of Oreg.

[73] Assignee: Tektronix, Inc., Wilsonville, Oreg.

[21] Appl. No.: 555,979

[22] Filed: Jul. 23, 1990

Related U.S. Application Data

[63] Continuation of Ser. No. 113,927, Oct. 26, 1987.

[51] Int. Cl.[5] ..... G09G 5/36

[52] U.S. Cl. ..... 340/747; 340/799; 395/143

[58] Field of Search ..... 340/724, 728, 734, 747, 340/799, 744, 750, 726; 395/118, 129, 133, 141, 142, 143, 162, 800; 364/900; 358/13; 382/25, 41

[56] References Cited

U.S. PATENT DOCUMENTS

| | | | |
|---|---|---|---|
| 4,197,590 | 4/1980 | Sukonick et al. | 340/726 |
| 4,394,774 | 7/1983 | Widergren et al. | 358/13 |
| 4,490,848 | 12/1988 | Beall et al. | 382/25 |
| 4,514,826 | 4/1985 | Iwata et al. | 395/800 |
| 4,550,437 | 10/1985 | Kobayashi et al. | 382/41 |
| 4,555,775 | 11/1985 | Pike | 340/747 |
| 4,586,037 | 4/1986 | Rosener et al. | 340/728 |
| 4,620,288 | 10/1986 | Welmers | 340/750 |
| 4,658,247 | 4/1987 | Gharachorloo | 340/747 |
| 4,674,032 | 6/1987 | Michaelson | 364/900 |
| 4,816,814 | 3/1989 | Lumelsky | 340/744 |

OTHER PUBLICATIONS

IBM Technical Disclosure Bulletin, "Graphic Bit-BLT Copy Under Mask", vol. 28 No. 6, Nov. 1985.

*Primary Examiner*—Alvin E. Oberley
*Assistant Examiner*—Richard Hjerpe
*Attorney, Agent, or Firm*—Francis I. Gray; Alexander C. Johnson, Jr.

[57] ABSTRACT

A high performance graphics display system for use as an engineering workstation includes a compact method of generating vectors and transmitting addresses for same from a picture processor to frame buffer control circuitry for writing or reading pixel values along the vector in the frame buffer. The system uses a multiplexed address/data bus. Off-screen memory in communication with the picture processor is used to store pixel data read along vectors in the frame buffer preceding writing a vector so that the original data can be restored when the written vector is moved or removed. Vectors are encoded by the picture processor as a first word containing the address of the beginning point of the vector and major axis and X and Y direction bits to indicate the vector's direction. A second word includes a minor axis bit, indicating whether the next pixel to be written or read is on or off the major axis, in the direction indicated for such axis in the first word. The first word also includes a hesitate bit indicating whether the first pixel of a vector is to be written or read. The system is configured in pipe stages with a FIFO at each stage controlled by a hold signal that is pipelined from downstream stages in a direction opposite the pipelined data flow.

35 Claims, 22 Drawing Sheets

5) SLOW WRITES (TYPICAL OF CONTROL REGISTER LOADING)

| CYCLE # | 1 | 2 | 3 | 4 | 5 | 6 | 7 | 8 | 9 | 10 | 11 | 12 | 13 | 14 | 15 | 16 | 17 |
|---|---|---|---|---|---|---|---|---|---|---|---|---|---|---|---|---|---|
| READ | -- | | | | | | | | | -- | | | | | | | |
| WRITE | -- | | | | | -- | | | | -- | | | | -- | | | |
| IR | -- | -- | -- | -- | -- | -- | -- | -- | -- | -- | -- | -- | -- | -- | -- | -- | -- |
| DATA (32) | aa1 | xxx | xxx | xxx | xxx | wd1 | xxx | xxx | xxx | aa2 | xxx | xxx | xxx | wd2 | xxx | xxx | xxx |
| ROR | xxx | xxx | xxx | xxx | xxx | xxx | xxx | xxx | xxx | xxx | xxx | xxx | xxx | xxx | xxx | xxx | xxx |
| RIR | xxx | xxx | xxx | xxx | xxx | xxx | xxx | xxx | xxx | xxx | xxx | xxx | xxx | xxx | xxx | xxx | xxx |
| ROE | | | | | | | | | | | | | | | | | |

FIG. 10E

6) SLOW READS

| CYCLE # | 1 | 2 | 3 | 4 | 5 | 6 | 7 | 8 | 9 | 10 | 11 | 12 | 13 | 14 | 15 | 16 | 17 |
|---|---|---|---|---|---|---|---|---|---|---|---|---|---|---|---|---|---|
| READ | -- | | | -- | | | -- | | | -- | | | | | | | |
| WRITE | -- | | | | | | | | | | | | | | | | |
| IR | -- | -- | -- | -- | -- | -- | -- | -- | -- | -- | -- | -- | -- | -- | -- | -- | -- |
| DATA (32) | aaa | | | | xxx | xxx | xxx | rd1 | xxx | xxx | rd2 | xxx | xxx | rd2 | xxx | | |
| ROR | xxx | xxx | xxx | xxx | | | | | -- | | -- | | | -- | | | |
| RIR | xxx | xxx | xxx | xxx | -- | -- | -- | -- | -- | -- | -- | -- | -- | -- | -- | -- | -- |
| ROE | | | | -- | -- | -- | -- | -- | -- | -- | -- | -- | -- | -- | | | |

FIG. 10F

3) BURST OF READ WITH LOWER LATENCY:

| | | | | | | | | | | | | | | | | | |
|---|---|---|---|---|---|---|---|---|---|---|---|---|---|---|---|---|---|
| READ | — | — | — | — | — | | | | | | | | | | | | |
| WRITE | — | | | | | | | | | | | | | | | | |
| IR | — | — | — | — | — | — | — | — | — | — | — | — | — | — | — | — | — |
| DATA (32) | aaa | | xxx | xxx | rd1 | rd2 | rd3 | rd3 | rd3 | rd4 | rd4 | rd4 | xxx | | | | |
| ROR | xxx | xxx | | | — | — | — | — | — | — | — | — | | | | | |
| RIR | xxx | xxx | — | — | — | — | | | — | | | — | | | — | — | — |
| ROE | | — | — | — | — | — | — | — | — | — | — | — | | | | | |

FIG. 10C

4) TWO READS FOLLOWED BY TWO WRITES:

| CYCLE # | 1 | 2 | 3 | 4 | 5 | 6 | 7 | 8 | 9 | 10 | 11 | 12 | 13 | 14 | 15 | 16 | 17 |
|---|---|---|---|---|---|---|---|---|---|---|---|---|---|---|---|---|---|
| READ | — | — | — | | | | | | | | — | | | | | | |
| WRITE | — | | | | | | | | | | — | — | — | | | | |
| IR | — | — | — | — | — | — | — | — | — | — | — | — | — | — | — | — | — |
| DATA (32) | aaa | | xxx | xxx | xxx | xxx | rd1 | rd2 | xxx | | aaa | wd1 | wd2 | xxx | xxx | xxx | xxx |
| ROR | xxx | xxx | | | | | — | — | | | | xxx | xxx | xxx | xxx | xxx | xxx |
| RIR | xxx | xxx | — | — | — | — | — | — | — | — | — | xxx | xxx | xxx | xxx | xxx | xxx |
| ROE | | — | — | — | — | — | — | — | | | | | | | | | |

FIG. 10D

TNT PP2 TRANSFORM ENGINE

TAG CHIP BLOCK DIAGRAM

TAG CHIP
ADDRESS ENGINE 202
(REGISTERS)
224
YoLd
222
Xold
220
Y
218
X
216
B
214
A
212
Er
210
MULTIPLEXOR
196
TBUS
13
12
24
28
ADDRESS OUTPUT
236
ADDRESS LATCH
238
OCTANT LATCH
4
1 SIGN OF Yold REGISTER
1
SIGN BIT OF Xold REGISTER
SIGN OF ALU OUPUT
MOVE FLAG (H) REGISTER
240
228
MULTIPLEXOR
226
MULTIPLEXOR
CARRY-IN
ALU
230
232
READ COUNTER
234
PIXEL COUNTER
TBUS CONTROL

FBC BLOCK DIAGRAM

LOCAL DISPLAY BUS ARCHITECTURE AND COMMUNICATIONS METHOD FOR RASTER DISPLAY

This is a continuation of application Ser. No. 113,927 filed Oct. 26, 1987.

BACKGROUND OF THE INVENTION

The present invention relates to frame buffer memory systems for raster displays, and more particularly to a bus architecture and communications method for interfacing a picture processor to a frame buffer.

Raster scan, frame buffer displays have become increasingly popular as the price of semiconductor memory has decreased. The image to be displayed is represented in a large memory that saves a digital representation of the intensity and/or color of each picture element, or pixel, on the screen. The frame buffer memory is equipped with hardware to generate a video signal to refresh the display and with a memory port to allow a host computer or display processor to change the frame buffer memory in order to change the image being displayed. A general overview of the art can be found in *Raster Graphics Handbook,* published by Conrac Division, Conrac Corporation, Covina, Calif. 91722 (1980).

Interactive graphics applications require rapid changes to the displayed image, which in turn require rapid changes to the frame buffer memory. Although the speed of the host processor and display processor is clearly important to high performance, so also are the properties of the memory system, such as update bandwidth, i.e., the rate at which the host processor or data processor may access each pixel. Many graphics systems are partitioned such that the image rendering engine is separated from the frame buffer by some kind of bus. In a low end system, where the rendering engine is a generic microprocessor and the frame buffer is a dual-ported memory, this bus may be the system bus. In a high-end system, such as an engineering workstation, where the rendering engine is a special purpose picture processor, this bus may be a high-speed private bus between the picture processor and the frame buffer. In either case, for drawing vectors of arbitrary orientation, it is necessary to send the address and data across the bus for every pixel to be written. This means that there must either be enough bus signal lines to send both the address and the data at the same time or, if it is a multiplexed address/data bus, every pixel write must be an address cycle followed by a data cycle.

In conventional raster display systems, a two-dimensional block of data (three-dimensional in color systems) is created in the frame buffer to represent an image to be displayed. Each data element defines a pixel, the pixel data consisting of an address defining the two-dimensional coordinates of the pixel, and a value, represented by a single binary bit in monochrome systems, and a number of bits in color systems. The pixel data is generated and transmitted a pixel at a time, first the address, then the pixel value, to the frame buffer control circuitry. This circuitry reads the address and places the corresponding pixel value into the frame buffer. This process is repeated for all of the pixels to be changed in the image. Having to send the address each time a pixel value is sent consumes much of the bandwidth of the communications interface between the display processor and the frame buffer.

Most bus systems have a "block transfer" mode to increase the data transfer bandwidth. In this mode, one address can be followed by multiple data words which are written to sequential memory locations beginning at the initial address. This mode can be used for sending vectors aligned with the X-axis or Y-axis but is not generally useful, however, for drawing vectors of arbitrary orientation into a frame buffer. This is because frame buffers are logically organized as a x-y array and the physical memory address is a combination of the x and y addresses. Since vectors of arbitrary orientation can go in any direction, the adjacent pixel addresses are not, in general, sequential memory addresses.

U.S. Pat. No. 4,586,037 to Rosener et al., incorporated herein, discloses octant register circuitry and a mode of operation that enable a full address to be sent along with a pixel value for such address to the frame buffer memory to define the starting point of a vector. Successive pixel data is sent in parallel with a three-bit address defining the octant in which the next pixel value will be placed relative to the previous address. The three-bit octant data thus defines the location of a next pixel to be written adjacent an immediately preceding pixel, without having to send the entire address before each pixel. Using this approach, particularly in application of line drawing algorithms in large memory arrays, can greatly improve efficiency but still requires at least three bits besides the data.

Another area of interest has to do with the drawing of images, such as cursors and lines, over images already being displayed, and movement of the line or cursor images without destroying the underlying image stored in the frame buffer. U.S. Pat. No. 4,197,590 to Sukonick et al. discloses an exclusive or (XOR) which allows a selective erase that restores lines crossing or concurrent with erased lines. XOR feature permits part of the drawing to be moved or dragged into place without erasing other parts of the drawing. This approach requires substantial computational overhead and has a number of operational limitations. Another approach, developed by Xerox Palo Alto Research Center and described by D. H. H. Engles, "The Small Talk Graphics Kernel" BYTE, August, 1981, pp. 168–194, incorporated herein, is an operation called "Bit Blt." The Bit Blt process uses a rectangular bit map to define the image to be written into the frame buffer. As the image is written into the frame buffer, the prior information in the same address locations is read out and stored in a separate memory. When the new image is moved or deleted, the old information is restored to the frame buffer in its original location. This method is suitably efficient when applied to nearly rectangular blocks of pixel data, particularly those of small size as in the case of a cursor image. Its efficiency is greatly reduced, however, when large portions of the pre-existing image must be stored and restored. That is the case even when relatively simple new images are to be placed on the display, such as lines, curves, or simple polygons.

Another communications interface limitation in prior raster display systems relates to the way information is relayed, or pipelined, through multiple data processing stages. U.S. Pat. No. 4,658,247 to Gharachorloo discloses an example of a prior graphics display system which uses a line buffer pipeline connecting a series of pixel processc to implement real-time image generation. In an ideal pipeline through the system, all stages process their respective data in the same amount of time. The data transfer mechanism between stages can be a simple register which is loaded with new data at the end of each processing cycle by a pipeline clock that is common to all pipeline stages. Problems arise, however, when one of the pipe-stages takes longer than one pipeline clock cycle to process its data. If that happens, that stage must be able to halt the data flowing to it from the previous stage while it finishes its processing, or break up its process into more than one pipe stage. The problem worsens if the time it takes for a pipe stage to complete its process is variable, depending either on its input data or on some random or pseudo-random event happening within the pipe stage. If that is the case, the only thing that can be done is to somehow stop the previous or upstream process from sending new data until a slower, downstream process is ready to accept it. This means that each process must have knowledge of the state of all of the following pipe stages, that is, whether or not they are ready to receive new data. The simplest way to implement this is to send a hold signal from a current stage to a previous pipe stage. This hold signal is a busy signal from the current stage logically ORed with the hold signal coming from a following or downstream stage. Because of the signal delay associated with each OR gate, however, this scheme is not appropriate for a high-speed system with many stages, especially if the implementation is a bus structured system.

Accordingly, a need remains for improvements in the architecture and communications protocols employed in a raster scan display system for generating and transmitting pixel data to and from the frame buffer.

SUMMARY OF THE INVENTION

One aspect of the invention is an improvement in the manner in which vector pixel data is generated and is transmitted to and from the frame buffer. This aspect of the invention, called imbedded vector direction control, provides an enhanced "block transfer" mode for a multiplexed address/data bus system so that vectors of arbitrary orientation can be drawn with one address cycle followed by one data cycle for each pixel of the vector. Each address word preferably contains, in addition to the x and y starting address, three bits of information specifying (1) the X direction, (2) the Y direction and (3) whether X or Y is the "major" axis, that is, the axis to be incremented for each subsequent pixel of the vector. Whether writing to or reading from the frame buffer, a data word is sent for each subsequent pixel. It contains one bit of information specifying whether or not a step is to be taken along the minor axis, that is, transversely of the major axis. This bit is interchangeably called the minor axis bit or FBSel. In writing to the frame buffer, a pixel value is sent to the frame buffer in each of the data words. In reading from the frame buffer, no pixel values are sent; the data lines are left open for pixel values to be read from the frame buffer and returned to the system memory or other off-screen memory. In preferred operation, a first word is sent with a full beginning point address and with major and minor axis direction information for the vector. Subsequently, a second word is sent for each pixel value to be sent or read. The second word includes the minor axis bit which specifies whether or not to step along the minor axis in the direction indicated by the directional bit for such axis sent with the starting address. To write pixel data in the frame buffer, each second word also includes a pixel value. Upon receipt of each second word, the frame buffer control circuitry increments along the specified major axis direction indicated in the three bits of specifying information, and increments along the minor axis in the direction specified in the first word, or not, as determined by the minor axis bit. This approach saves bus lines or additional bus cycles for rendering vectors, and therefore increases effective bandwidth. With somewhat less efficiency or one more bus line, this approach can also be implemented by sending just a major axis selecting bit and a direction bit for the major axis in the first word, and sending both a minor axis bit and minor axis direction in the second word. This method can be adapted to drawing of curves, as well as lines, and, by transmitting new starting address and directional information at appropriate octant transition points or vertices of geometric figures, can be used to form more complex curved or polygonal images.

A second aspect of the invention, called "Vector Blt" is a method of reading or writing pixel values at a sequence of addresses in a frame buffer, where the addresses are generated by means of a digital line-drawing algorithm and the pixel values are transferred between the frame buffer and off-screen memory over the system bus. It can be used as a method of non-destructively placing cursors, icons or other graphic entities into a frame buffer when the entities are described as vector lists. The method can be extended to curves and other scan-converted graphic entities. Vector Blt can be used for saving portions of an image to off-screen memory and restoring pixel data in the frame buffer when temporarily placing vector-defined cursors, icons, etc. there. Vector Blt is a more efficient way of saving/restoring pixels of a graphic entity that spans a large area but is made up of just a few lines, such as cross hairs, circles and other simple shapes. Vector Blt can thus be used to move blocks of information defined by polygons that are not limited to rectangles aligned with the X and Y axis of the frame buffer. Using Vector Blt, the pixels of a pre-existing image underlying the cursor are read out and saved in off screen memory, the cursor destructively written over those pixels, and then, when the cursor is removed or moved, the saved pixels are restored from the off-screen memory using another Vector Blt operation. With appropriate applications and display processor software, Vector Blt can be used interchangeably or in combination with Bit Blt to provide optimum efficiency of temporary placement and movement of combinations of vectors, curves and block information in the frame buffer. The speed and efficiency of Vector Blt is further enhanced by implementation using imbedded vector direction control for reading, as well as writing pixel data in the frame buffer.

A third aspect of the invention is a pipelining structure and method which allows a pipeline to be easily expanded without affecting performance, even if the pipe stages have different or varying processing times. This is accomplished by distributing a first in, first out (FIFO) memory among the pipe stages. A transparent latch is added in front of each pipe stage and acts as a one-deep FIFO at the input of each pipe stage to store the data being sent from the previous or upstream stage when the current stage is not ready to receive it. A register, clocked by the pipeline clock, is added to each stage to latch the current hold signal, sent from a following or downstream stage, before it is sent to the previous or up- ream stage. The hold signal of one stage causes a hold signal to be generated by the next upstream stage during the following clock cycle as the process of latching the data and transmitting the hold signals continues up the pipeline. In effect, the hold signals for each stage are pipelined in the opposite direction of the data. The ability to latch one clock cycle worth of data in the FIFO is necessary because the hold signal is delayed by one clock cycle for each pipe stage. Pipelining the hold signal, however, eliminates the need to have cascaded or very wide logic to collect the busy signals from all the pipe stages and the resulting structure can be readily expanded to an unlimited number of pipe stages.

The foregoing and other objects, features and advantages of the invention will become more readily apparent from the following detailed description of a preferred embodiment which proceeds with reference to the accompanying drawings.

BRIEF DESCRIPTION OF THE DRAWINGS

FIGS. 10A through 10F are timing diagrams of examples of read and write operations over the local display bus.

DETAILED DESCRIPTION

Graphics System Overview

Figure 1:
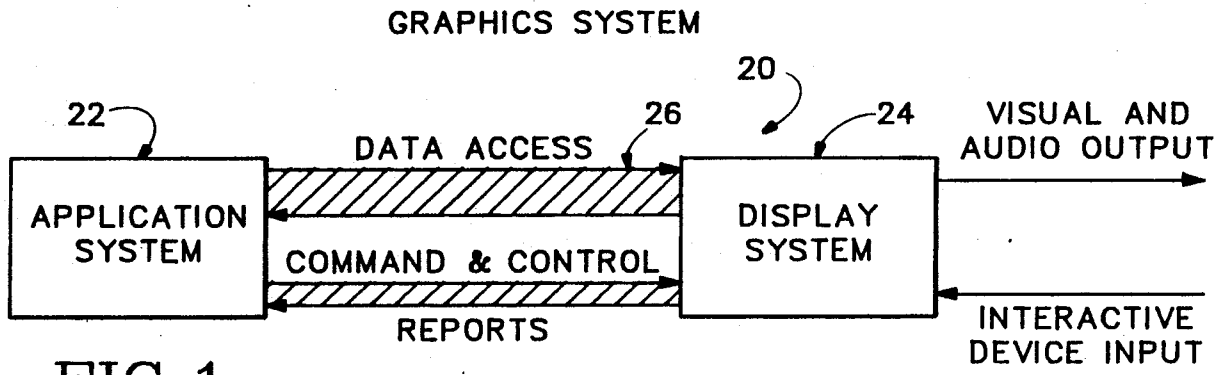
FIG. 1 is a general functional block diagram of a graphics system in which the invention is implemented.

The graphics system 20 can be divided, as shown in FIG. 1, into three types of subsystems: the application system(s) 22, the graphics display system 24, and communication channel 26 linking the application and display systems. Separating the application and display systems allows the graphics system functionality to be packaged in a number of different ways, with the performance characteristics of the application, communication, and display systems tailored to requirements of the user.

Figure 2:
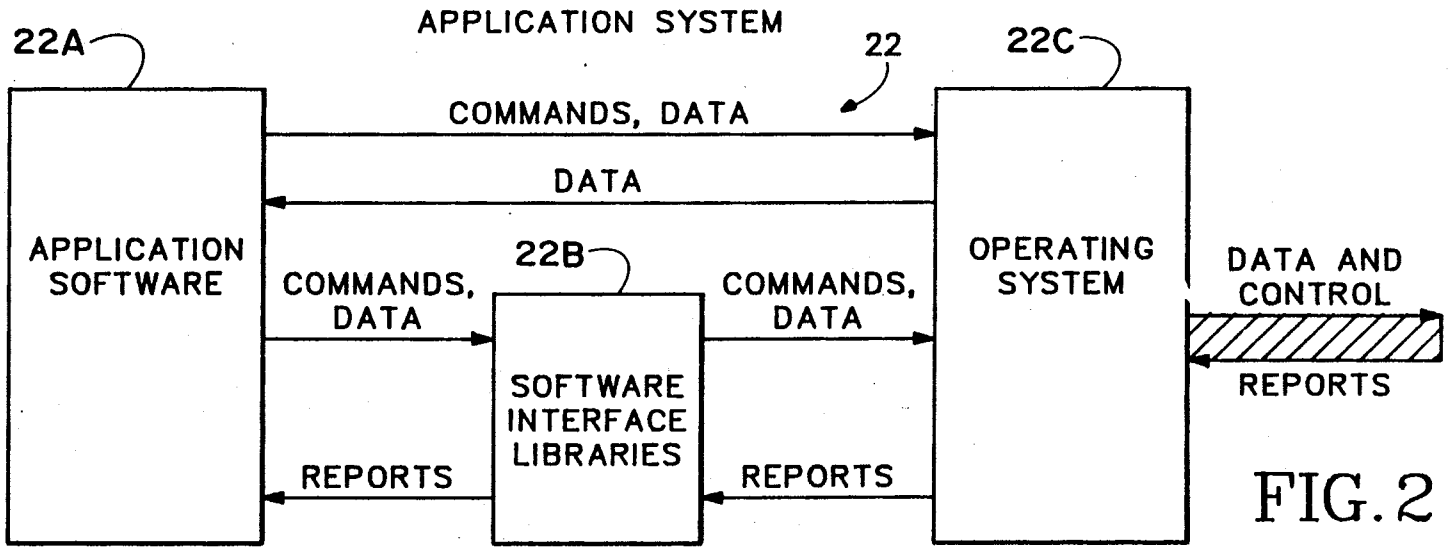
FIG. 2 is a functional block diagram of the software architecture of the applications system shown in FIG. 1.

Application system 22 contains an application engine, application programs, application data bases, and interfaces to the communication channels which can provide links to the display system. Application engines range from local workstation computing engines to the largest mainframe super computers, and the applications programs running on them cover a wide range of functionality. The application system 22 consists of an application engine or general purpose computer. It is run by application software 22A, software interface libraries 22B, and an operating system 22C and their interconnections are shown in FIG. 2. Further details of the application system are not germane to the present invention.

Figure 3:
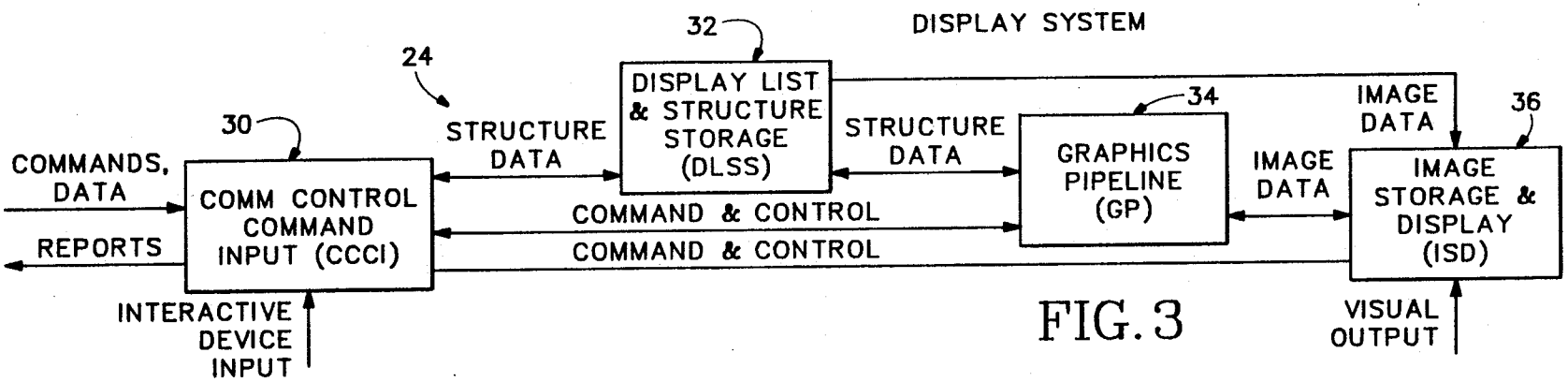
FIG. 3 is a functional block diagram of the display system shown in FIG. 1.

The display system 24, shown in FIG. 3, handles interactive devices, manages graphic data structures, generates display images, and interfaces to the communication channels which connect to the application systems. The display system contains all the elements to close the loop from the user's input to his graphical feedback. Highly interactive graphical applications can be run when the communications channels have a relatively low bandwidth. The display system is able to store graphic data structures and to generate display images. Even when the communications bandwidth is very high, this capability offloads a great deal of work from the programs executing on application systems.

The communications channels 26 between the application systems and the display system may take many forms. The channels may vary in bandwidth from that of asynchronous serial communication lines to that of a direct connection with a high-speed data bus. Data protocols on the channels may be as simple as asynchronous RS-232C or as complicated as that of IEEE 802.3 (Ethernet).

General Overview of Display System

The display system 24 is functionally divided into subsystems representing communications/control command/input (CCCI) 30, display list and structure storage (DLSS) 32, graphics pipeline (GP) 34, and image storage and display (ISD) 36. These subsystems and their interconnections are shown in FIG. 3.

Communication channel handlers 30 include both hardware drivers and software protocols. Hardware drivers for communications devices handle the details of hardware signal levels, timing, and protocols. Special integrated circuit (IC) chips are available to drive most major communications protocols, as is the driver software that controls these ICs. Software communications protocols are ~ed with communications hardware to control the passing of messages and data on channels.

Display system control includes run time control, data path control, and context control for monitoring and control of the display system. At system start-up, the display system is powered up and initialized. Diagnostics and self test are done during system initialization, and also can be performed upon command after the system is running. Supervisory services in the run time environment of the display system include message passing, process synchronization, and resource allocation. The control of data paths and data transfers is an important part of the display system supervision. For example, command streams from the communication channels may be handled by a number of different data consuming processes, depending on the configuration and state of the system. The supervision of display system contexts for the graphics environments of windows and virtual terminals involves the coordination and control of contexts for communications, command, interactive input devices, graphics structures, and display list storage. Resources of the display system as a whole, including communications channels, interactive devices, image storage, and display control, are allocated to various contexts on either an exclusive use or a shared basis.

Command streams from application systems give application programs the use of the functionality of the display system. A user command interface enables the user of the display system to execute commands locally. When interactive input devices are used, the system issues device control, read and process device data, and initiates graphics actions within the display system's contexts for graphics environments with windows and virtual terminals.

Graphics actions initiated by input from an interactive device include moving graphical objects, selecting or "picking" visible objects, and switching the graphics context of input devices or command streams from application systems. Graphics objects can be moved, rotated, scaled, and transformed under control of input devices. Any attribute (continuous or discrete) of a graphics structure or object might be modified by data from an input device. This can involve color, shading, and lighting models as well as position and orientation. Selection of graphical objects and menu items usually is done with interactive positioning devices.

Display list storage 32 holds display lists and structures which are used by both the CCCI 30 and the graphics pipeline 34. These display lists and structures play a key role in the communication between the CCCI and the GP. Graphical "objects" are represented by display lists (structures to be interpreted by the GP) and control structures which are used for the generation of images on the display screen. The creation of graphic objects involves building both these display lists and control structures. After objects are created their display lists and control structures can be modified to cause changes in their displayed images. Graphics data structure variables determine the "state" of the system. The control of the graphics contexts for windows and virtual terminals involves switching the data variables and structures representing graphical segments or objects, viewing, display lists, and the state of image generation processes.

The graphics pipeline (GP) 34 contains the facilities for reading and interpreting display lists, for scan converting display list descriptions of graphical entities into lower-level pixel descriptions, and for directly manipulating pixel descriptions such as pixel arrays or bit maps. When the system needs to generate a display image, a control protocol is used to give the graphics pipeline display list traverser a display list representing the picture. This causes the display list traverser to start traversing the display list. The display list contains graphics commands such as graphic primitives, references to pixel arrays, mode setting and attribute setting instructions, and flow of control instructions. Transformations can be used to compose complex objects using simple primitive shapes that are repetitively used in a manner analogous to subroutine calls in a programming language.

Scan conversion refers to the process of converting descriptions of graphic primitives (e.g., line, character, polygon, . . . ) into sets of pixels which are stored in the frame buffer. The descriptions input to this process are fairly high level—geometric information and attribute information such as position and size of text, endpoints and color of a line, or edges of a polygon and a pattern to be used to fill its interior.

Pixel/raster operations involve the movement of blocks of pixels within the frame buffer itself, between the frame buffer and general system memory, or within the general system memory. In the architecture described herein, there is a distinction between these two memory address spaces. Some limited forms of processing can take place on a pixel-by-pixel basis when pixels are transferred.

The image storage and display system 36 provides the primary feedback to the user/operator. Its function is to provide the user with graphical output from the application and graphical feedback for local user input. The image storage is generally a pixel-based memory system which can be written and read by the image generation system, usually a frame buffer (i.e., it stores information describing each displayed pixel). In addition to storing the image, this system also controls and outputs data to the physical display. Since most pixel-based displays must be refreshed, this system must also have a high-speed output channel to the physical display. The physical display is the device on which the image or picture is formed under the control of the image storage system. Preferably it is a raster scan video type display device capable of full color image generation. The resolution of the display device is matched to the size and addressability of the image generation system.

Display System Architecture

Figure 4:
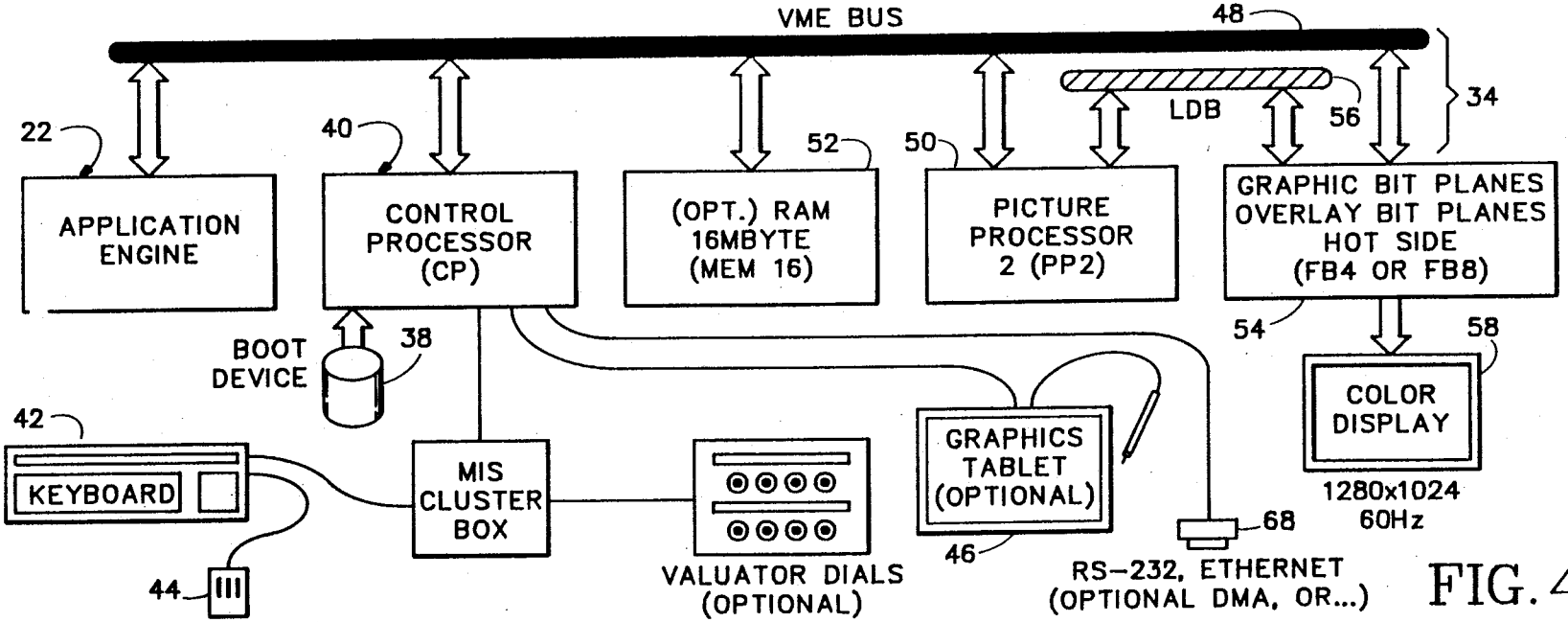
FIG. 4 is a block diagram of a preferred physical implementation of the display system shown in FIG. 3.

The physical partitioning of the architecture of the display system 24 is shown in FIG. 4. Except for the interactive devices and a boot device 38, all the control processor functions 30 are preferably implemented in one large multi-layer circuit board called the CP board 40 and software running on a microprocessor on the CP board. Interactive input devices, such as a keyboard 42, mouse 44 and a graphic input tablet 46, are connected to the CP board 40 via either serial RS-232 ports or other suitable interface. The CP board 40 communicates with the graphics pipeline 34 via a system bus (VME) 48. A block diagram of the CP board is shown in FIG. 5 and described below.

Figure 8:
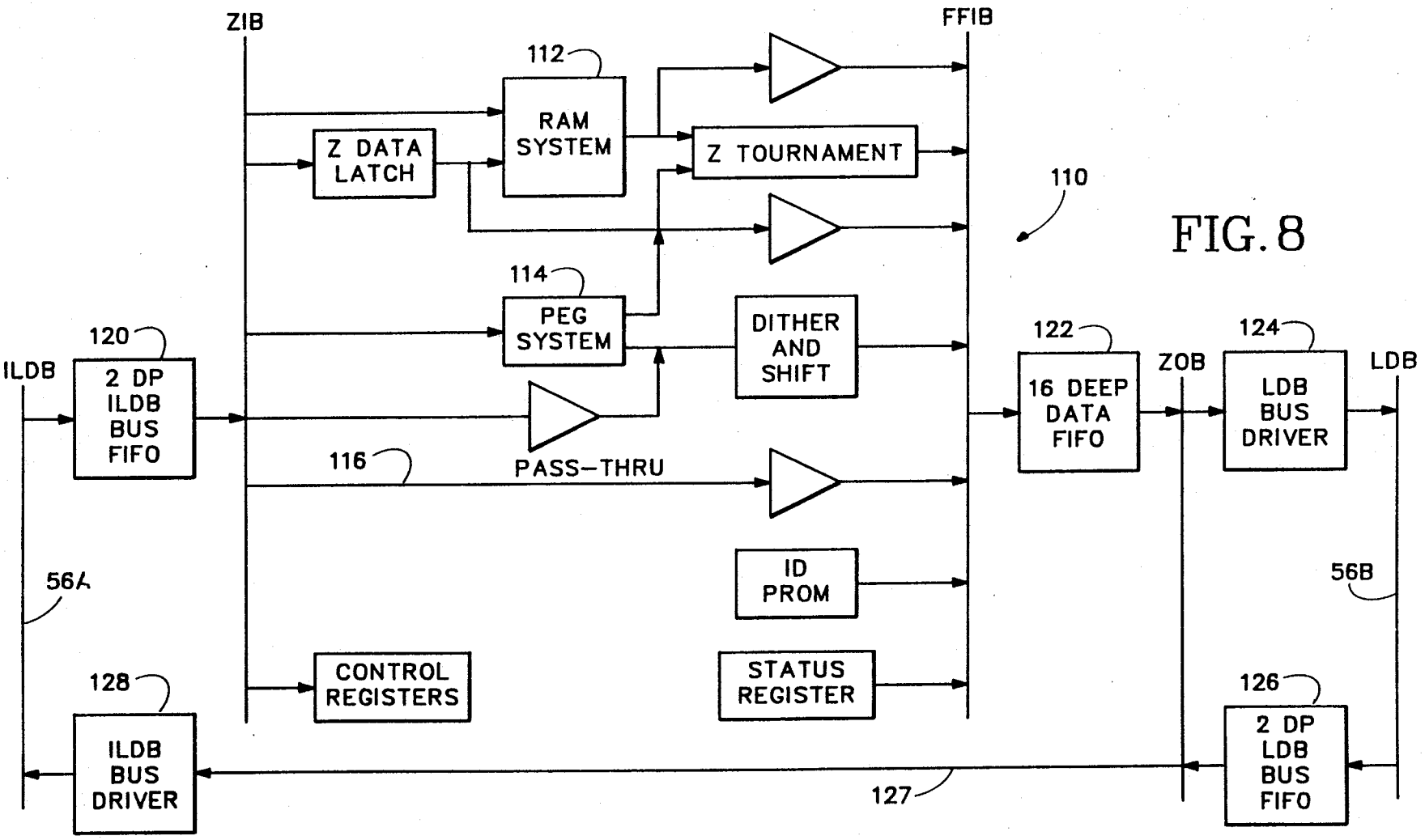
FIG. 8 is a high level block diagram of a Z buffer used in the graphics pipeline of FIG. 7.

All the functions of graphics pipeline 34 except for the final stages of 3-D shading are implemented on one circuit board called picture processor 2 (PP2) 50. The final stages of 3-D shading are implemented on an optional Z-buffer board (FIG. 8). The PP2 communicates with the CP and a shared memory 52 via the VME system bus 48 and with the frame buffer system 54 via a special purpose local display bus 56. The higher level functionality of the graphics processor 34 is implemented in microcode running on a microcode engine called a bit slice engine (FIG. 12A), while some lower level functions such as image transforms and imbedded vector direction control are implemented by special purpose hardware (FIGS. 12B, 12C and 12D).

The frame buffer 54 can have various implementations. For example, for a color display, there can be a single-board 8 plane (256 color) system, or a 2-board 12-plane (4096 color) system. By adding a second frame buffer board, the 12 plane system can also be configured as a 24 plane system. By depopulating the 8 plane board a single board 4 plane (16 color) system can be produced. A single plane board suffices for a monochrome display. In a preferred implementation, the display is a 1280×1024 color CRT monitor running at 60 Hz non-interlaced.

Figure 5:
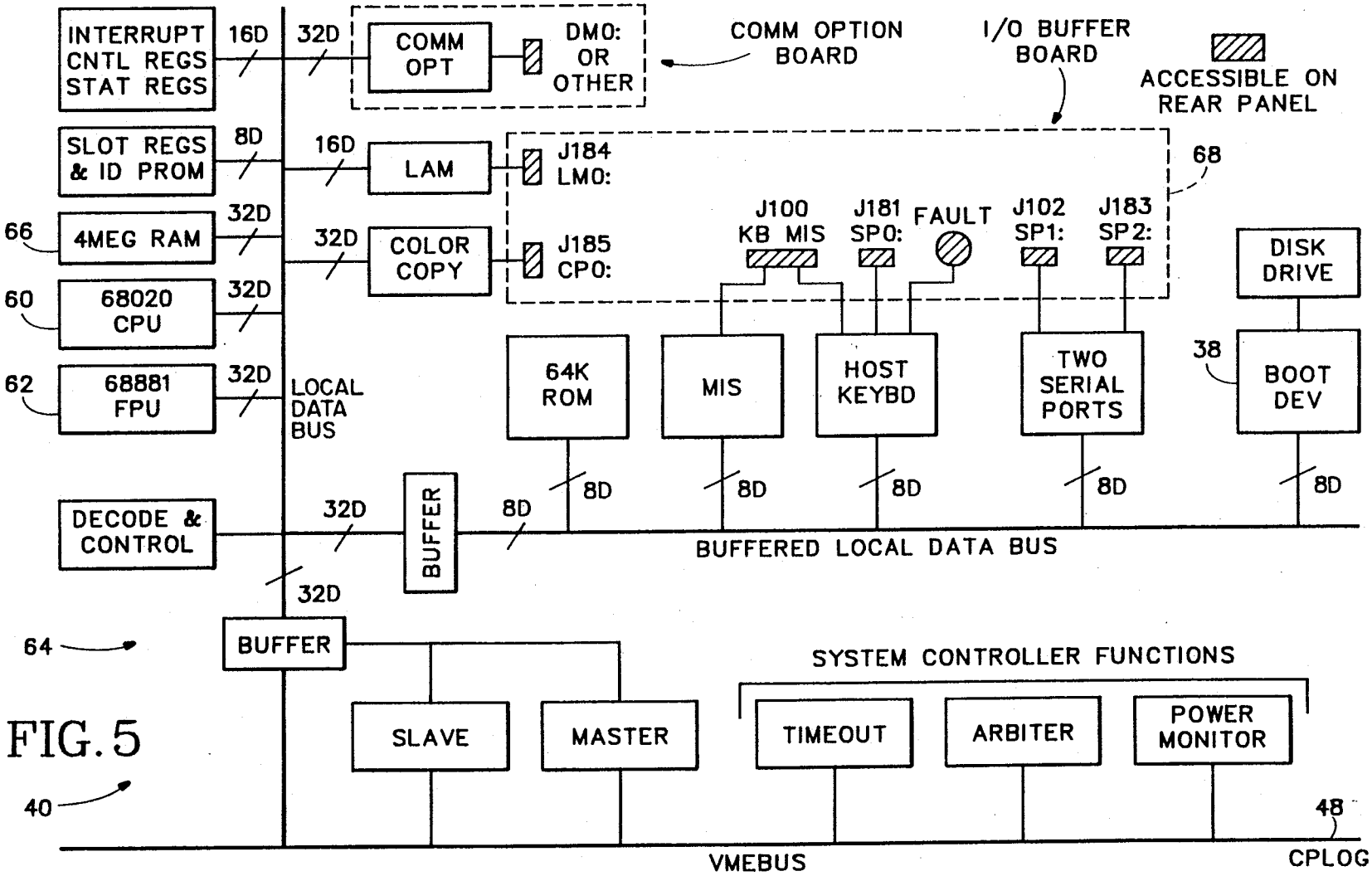
FIG. 5 is a block diagram of the control processor shown in FIG. 4.

Referring to FIG. 5, the control processor 40 performs the high-level graphic and I/O control tasks. These tasks include handling communications with the application engine (AE) 22; interpreting or routing command streams from the AE; building commands for the graphics pipeline when appropriate; creating and managing internal graphics data structures; managing input from the user; and managing the graphics pipeline. To a large degree, the CP is the part of the display system which determines the functionality and semantics of the graphics display system 20 as seen by the AE and by the user. In a preferred embodiment, the control processor (CP) 40 includes a 16 MHz Motorola 68020 microprocessor 60 and a 68881 floating point coprocessor 62. It also includes system bus interface circuitry 64 to interface the 68020 to the system bus (VME) 48. It thus allows communication with other processors or memory systems on the bus. A CP memory 66 provides 4 Mbyte of on board RAM. The communication interfaces 68 allow the CP to communicate with external devices. This interface supports RS-232 serial communications at speeds up to 38400 baud (asynchronous) (external clocking allows higher rates); two RS-232C serial communications ports and a Centronics style hardcopy port; and connection to an IEEE 802.3 (Ethernet) network.

Immediately after power-up, the microprocessor performs initial diagnostic tests to ensure that the system can be loaded from the boot device. After the initial self test, the boot device is used to load the DS software and GP microcode. The boot device can be a 5¼" floppy disk with 1 Mbyte of storage capacity. Code for the power-up, initial self test, and boot load of the CP system is contained in PROM/ROM which resides in a particular "power-up" portion of the microprocessor's address space 66.

The control processor subsystem 40 (and the application engine (AE) subsystem 22 in a workstation configuration) communicates with the graphic pipeline logically via a display list and other data structures 32 in shared memory 52, and physically via the VME system bus 48. (See FIG. 7.) Any memory accessible on the bus (e.g., memory 66 on the CP board in a base terminal configuration) can be accessed by pipeline stages that are bus masters, such as the picture processor described hereinafter.

This communication is between the CP board 40 and a PP2 board. The CP and PP2 have both master and slave interfaces to the VME bus 48. The master interfaces are the primary interfaces used during normal system operation. They are used for traversing display lists and accessing data structures (these may or may not be logically shared with the CP or other VME bus masters). The VME slave interface on PP2 is used during initialization, microcode debugging, self test execution, and for receiving interrupt requests. The slave interface makes certain hardware elements of PP2 visible to the CP/AE over the VME bus.

The most important data structure built by the CP for the graphic pipeline subsystem is the display list 32 (FIG. 3), which provides a byte oriented stream of instructions including graphics commands and associated data. All graphical operations, including operations executed on boards in the frame buffer subsystem, are controlled (or at least supervised) through the display list.

Graphic Pipeline Subsystem

Figure 6:
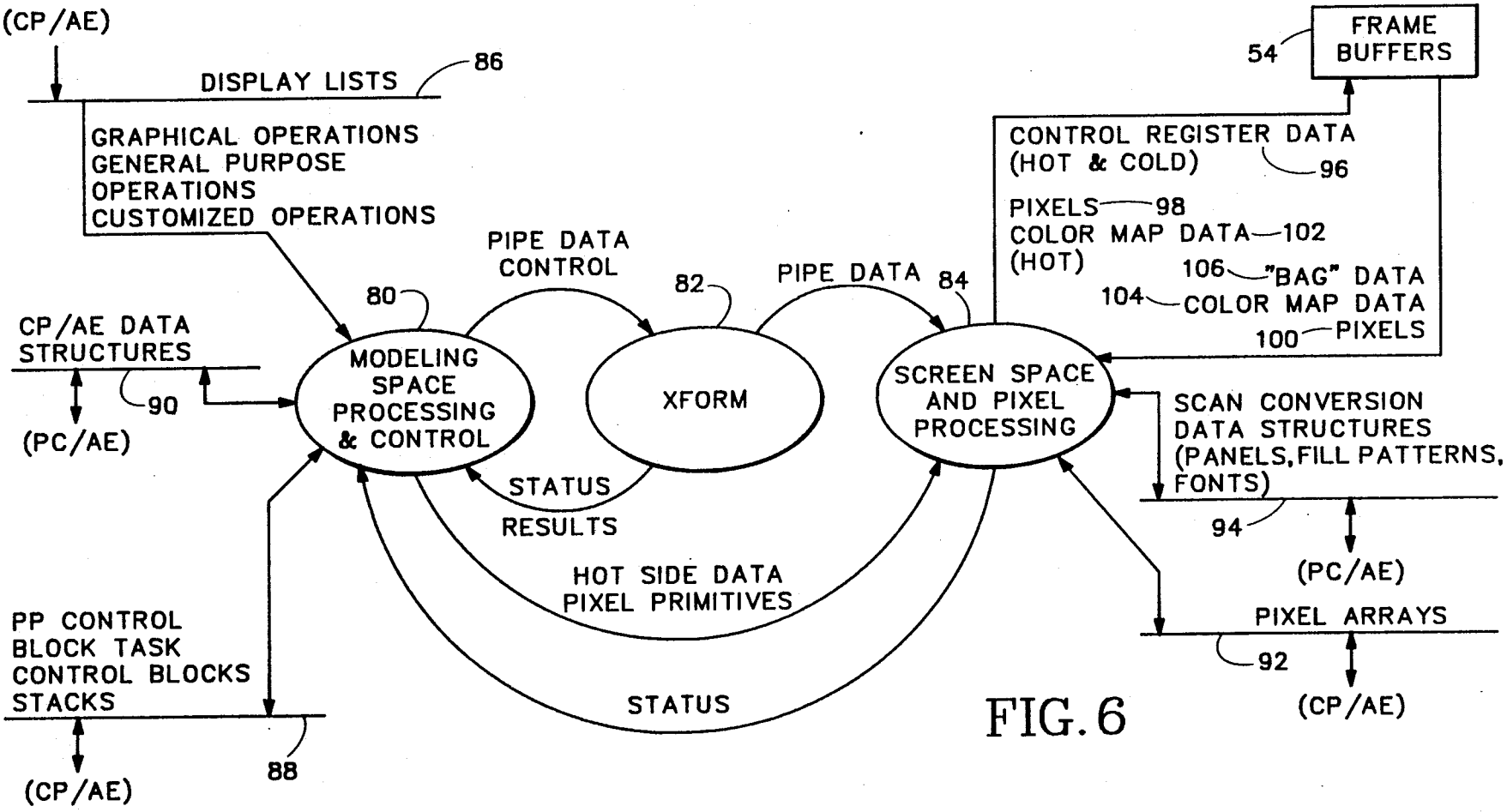
FIG. 6 is a data flow diagram of the graphics pipeline shown in FIG. 3.

A top-level breakdown of the functionality of the graphic pipeline 34 (FIG. 3) is presented in FIG. 6 in the form of a data flow diagram. In this diagram, the circles represent processing, and the horizontal lines represent data structures. Arrows show the flow of data, and boxes represent I/O devices (data sources/sinks). The following briefly describes the entities shown in the data flow diagram. The graphics pipeline is divided into three major processing subsystems—the modeling space processing and control (MSPC) subsystem 80, the transform (Xform) subsystem 82, and the screen space and pixel processing (SSPP) subsystem 84. Many data structures in shared memory are accessed (some are modified) by the various subsystems. All three subsystems may perform both fixed point and floating point computations.

The term "modeling space," within the context of the graphics pipeline, is used to describe the coordinate space in which geometry is defined in the display list. The MSPC subsystem 80 supervises all interfaces between the control processor (and/or application engine (AE)) and the graphic pipeline and frame buffer systems, and is responsible for management and coordination of multiple contexts/tasks within the graphic pipeline. It also performs such computations as are necessary on "pre-transformation" (modeling space) display list coordinate data.

The transform (XForm) subsystem 82 handles numerically intensive operations on scalars, points (coordinate transformation), vectors (dot and cross products, length normalization), and matrices (matrix multiplication, determinant evaluation, solution of linear systems).

The screen space and pixel processing subsystem 84 includes facilities both for scan conversion of graphic primitives (lines, text, panels, and facets) and for direct manipulation of pixel data (Bit Blt, Vector Blt), to include clipping/scissoring to rectangular regions and lines or curves of the frame buffer, as described hereinafter.

The graphic pipeline acts as an instruction set processor, executing display programs resident in system memory that is shared by the application engine, control processor, and graphic pipeline subsystems. The programs are called display lists 86. The display lists can be built by the application engine and/or control processor. The graphic instruction set includes orders called opcodes for drawing graphic primitives and controlling their attributes. In addition to the usual graphic opcodes, the graphic pipeline architecture allows a simple "general purpose" instruction set to be added. This could facilitate the creation of autonomous, algorithmic display lists (in support of real-time dynamics, programmed animation, and CP-less systems). Additional defined opcodes can be added to the pipeline order set to provide access to microcode for customized operations. Besides display lists, there are control blocks 88 in shared memory. These include the pipeline control block, the display task control blocks, and associated data (e.g., stacks). These structures hold "environmental state" information for the various display lists. Each "independent" display list has its own task control block and stack.

The MSPC subsystem 80 handles the pipeline side of the display list and control block access protocols. It contains a display list parser and dispatching mechanisms. It translates data from display list formats to internal pipeline format. It manages the stack associated with each display list. The general purpose pipeline opcodes are executed by the MSPC subsystem. The MSPC sends "hot-side-data," pipe data, pixel primitives, and/or control information to other pipeline subsystems, and receives status and/or results back from various subsystems. The MSPC module contains the central control and communication node within the data flow network for the graphic pipeline. Display list traversal and support for other external protocols are logically contained within this module. Display list opcodes whose functions are primarily control oriented (mode setting operations, transfer of control operations, etc.) are executed within the MSPC subsystem. Code that gives the CP access to the hot side facilities also logically resides within the MSPC subsystem. The term "hot side" refers to the video output side of a frame buffer—the hardware facilities involved in raster scanning the frame buffer and producing the video and timing signals for the CRT 58. Also included in this category are all other video signal sources whose outputs are mixed into the digital video stream on its way to the CRT. In contrast, the "cold side" of a frame buffer is the random access port through which scan conversion and raster operations are done. All access to hot side facilities occurs via the pipeline and the hot side data are accessed via display list opcodes. "Pixel primitives" are graphic primitives (lines, text, markers, panels, etc.) whose geometric coordinates are expressed directly in frame buffer pixel coordinates and, as such, do not need to be transformed. Pixel space primitives provide the highest attainable pipeline throughput from display list to frame buffer by bypassing all transformation processing. Pixel space primitives are provided in the microcode/software by means of a display list instruction that disables transform processing.

The transform (XForm 82) subsystem's primary purpose is to perform modeling and viewing transformations upon display list coordinate data. It also performs matrix multiplications on coordinate data. It also performs matrix multiplications (for creating composite transform matrices) and perspective division. Other math intensive operations are executed in the transform subsystem. "Pipe data" refers primarily to the stream of graphic primitive coordinates (modeling space in, screen space out) flowing from the MSPC subsystem, through the transform subsystem, into the SSPP subsystem.

The SSPP subsystem 84 is responsible for viewport-/viewbox clipping, scan conversion of graphic primitives, and raster operations on pixel arrays. The SSPP takes descriptions of graphical entities specified in pixel space (and Z-buffer) coordinates, generates (or retrieves) the appropriate sets of pixels, and moves them to/from the frame buffer or main memory. The algorithms performed by the SSPP subsystem are implemented by a mix of microcode and hardware.

Architecturally, pixel arrays 92 in shared system memory 52 can be sources and/or destinations of Bit Blt and Vector Blt operations. The scan conversion of graphic primitives by the SSPP subsystem can modify pixels in these main memory pixel arrays as well as in the frame buffer. When scan converting panels (arbitrary areas), the SSPP subsystem uses scan conversion data structures 94, including "siding lists," "scanline lists," and "fill pattern data structures." Bit mapped character fonts and marker fonts are stored in a format similar to that of other pixel arrays. Each character/-marker definition occupies a subrectangle of the overall font pixel array. Dash patterns for lines and halftone patterns for Bit Blt and Vector Blt have their own special data formats.

Finally, there are several data flows to/from the frame buffer subsystem 54. Control register data 96 is one. A number of control registers exist within the frame buffer subsystem. Some of these are on the "hot side," such as video multiplexer routing control registers and frame buffer visibility masks. Others are on the "cold side," such as the pixel combination rule registers, read/write masks, and local display bus address mapping registers.

The primary data stream flowing between the pipeline subsystem and the frame buffer subsystem is a stream of pixel data 98. The fundamental mode of transfer is as linear blocks of data sequentially written to (pixels 98) or read from (pixels 100) locations in the frame buffer, along the path of a Bresenham algorithm vector in the frame buffer's address space. Using imbedded vector direction control, an address cycle need occur only at the beginning of each block, with data cycles occurring at each pixel.

Color map data 102 for the red, green, and blue video look-up tables, as well as data for the overlay bit plan index tables, is transmitted to these tables via the graphic pipeline. A read back path, through the pipeline, makes output color data 104 available for system diagnostic testing.

"Bag" data 106 refers to data stored in a local display bus activity register. Using it, a VME bus master can capture pipeline output data that would ordinarily go to the frame buffer, and use it for other purposes such as updating a "virtual" frame buffer in system memory, or diagnostic testing. The bag is activated/deactivated by writing to a control register within the frame buffer subsystem. When it is active, each LDB write cycle destined for the frame buffer memory is intercepted and stored in the bag, and the pipeline is held off until the cycle is unloaded by a VME bus master.

Figure 7:
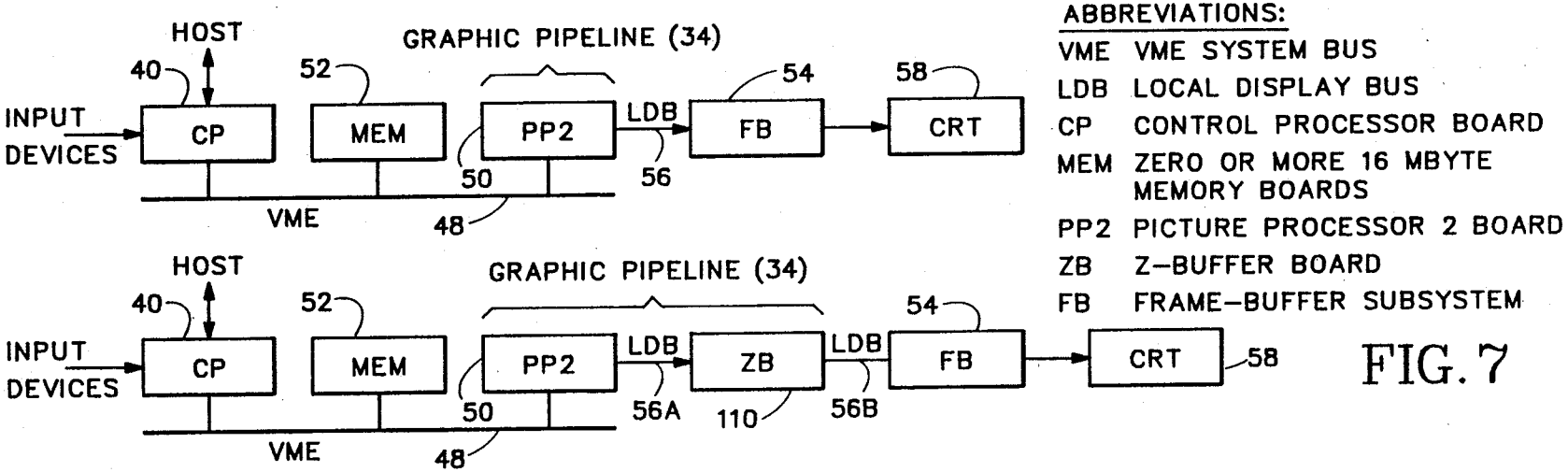
FIG. 7 is a simplified block diagram of two examples of configurations of the graphics pipeline.

In the two block diagrams shown in FIG. 7, pipeline data flows from left to right in accordance with the positions of boards. The control processor subsystem 40 is logically to the left of the graphic pipeline 34 (including PP2 50 and LDB 56) and the frame buffer subsystem 54 is logically to its right. The preferred implementation contains the picture processor (PP2) board and its microcode, and optionally can include a Z-buffer (ZB) board. When used, the ZB board divides the LDB into two parts 56A, 56B.

FIG. 8 is a h:-h-level block diagram of the ZB board. The Z-buffer algorithm 110 implemented in a central portion of the diagram is a simple and well known technique for hidden surface removal that is used in the rendering of images of 3D geometric surfaces on raster displays, so it is not described in detail. In the preferred embodiment, the Z-buffer 110 contains 1280×1024×16 bits of Z-buffer memory 112 for storing depth information at each pixel location. Also housed on the ZB board is special hardware for tiling triangular surface patches. This hardware consists of a programmed logic control unit and a data path gate array called the plane equation generator (PEG) chip 114. The functions of this hardware are: (1) to compute the depth and intensity at each pixel of each triangle; (2) to pass the intensity values of pixels (in visible portions of triangles) to the frame buffer; and (3) to keep the Z-buffer memory updated (so that each pixel location always contains the Z value from the triangle that is nearest the viewing position). The ZB board also includes a pass-thru path 116 for bypassing data around the Z-buffer function.

Figure 17:
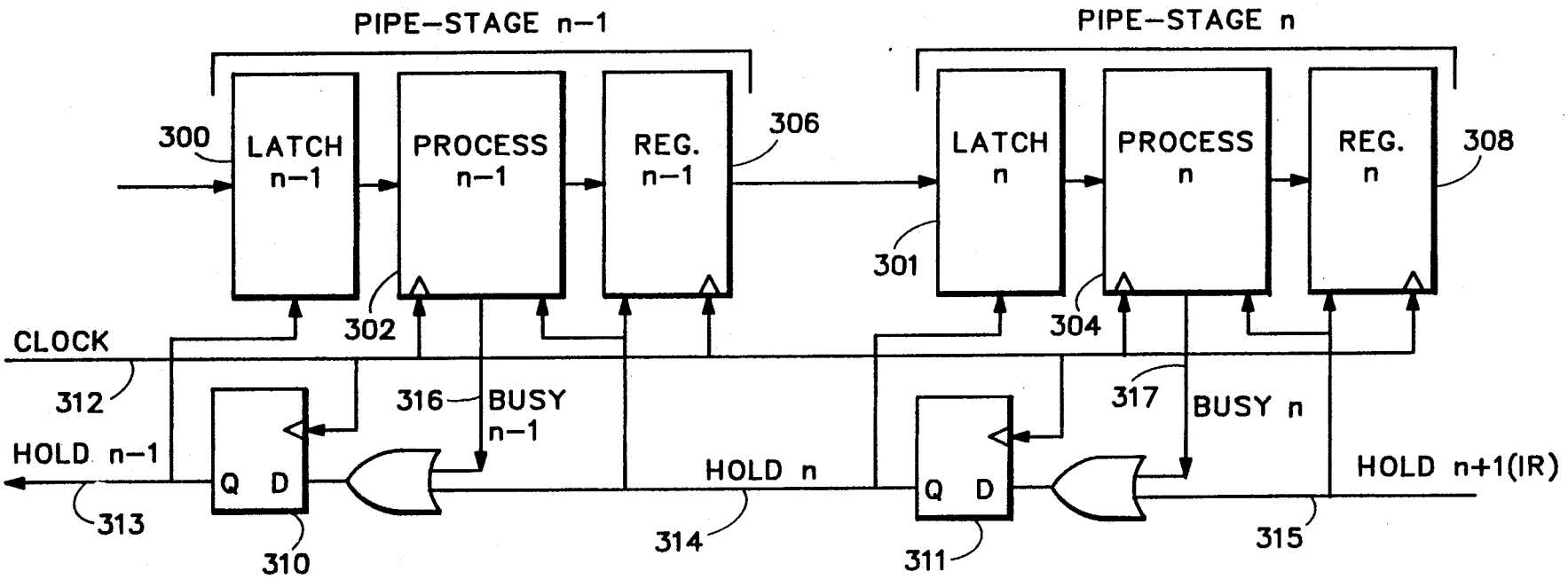
FIG. 17 is a more detailed block diagram of the distributed FIFO process used in the circuitry of FIGS. 8 and 15.

The hardware interface between the PP2 and Z-buffer, on the "right" or "downstream" side of PP2, is a clocked, bidirectional, 32-bit, multiplexed address and data bus that is the local display bus (LDB). The bus has an input side (ILDB) 56A and an output side (LDB) 56B. Therefore, the ZB board has a slave interface to the ILDB 56A on its input (left, upstream) side and a master interface to the LDB 56B on its output (right, downstream) side. Data is input through a 2-deep bus FIFO unit 120 and output through a 16-deep data FIFO 122 into an LDB bus driver 124, which transmits data to the frame buffer subsystem 54. The ZB board also has a return data path 12, bypassing ZB 110. Return data enters a 2-deep FIFO 126 from LDB 56B and is output to PP2 50 by ILDB driver 128. The FIFO and their operation are further described below (FIG. 17).

The following sections describe the interface between the graphics pipeline and the frame buffer (Local Display Bus), the picture processor (PP2), and the frame buffer control (FBC)

Local Display Bus (LDB)

As mentioned previously, the graphic pipeline is interfaced to the frame buffer via the local display bus (LDB). Following is a brief description of the structure and functions of the LDB, with reference to FIGS. 9 and 10A through 10F.

The LDB 56 connects PP2 50 to the ZB board and the ZB to the FB=Frame buffer 54 (or PP2 directly to the FB if the ZB 110 is not used). The bus (shown in greater detail in FIG. 15) is preferably a 32-bit multiplexed address/data bus synchronized by a common 74 ns clock. Each address or data cycle lasts one clock cycle. Multiple data cycles are allowed for each address cycle, with implied address incrementing (increment value previously communicated to the slaves). Each board has a FIFO of depth 2 or greater for receiving data (or addresses). Since the ZB can receive data from both sides, it has two left-to-right FIFOs 120, 122 and a return or read FIFO 126, as stated above. The frame buffer subsystem 54 has an FB In FIFO 130 and an FB Read FIFO 132 for writing or reading pixel data in the frame buffer memory 136. The communications interface of the PP2 board 50 is provided by a vector address generator or tiling address generator, referred to simply as "TAG chip" 138. (The tiling function is preferably provided to enable use of a ZB board but is not germane to the present invention and is sufficiently described in U.S. Pat. No. 4,755,810 issued Jul. 5, 1988 to David L. Knierim entitled "Frame Buffer Memory".) The TAG chip 138 includes an output FIFO 140 and an input FIFO 142, which may readily be combined into one FIFO for use as an alternating I/O FIFO on a multiplexed address/data bus.

Handshaking is done by input ready and output ready signals. The sending side of a board need not have a FIFO, but must generate an output ready signal and receive an input ready signal. In a system without a ZB, PP2 is the master and the FB is the slave. In reading pixel data from the FB, FIFO's 130, 132, 140 and 142 control the pipeline. When the ZB is there but not active, the LDB passes through it with three pipe stage delays in each direction (does not affect burst rate, just latency). The ZB also listens as a slave. When told to be active (by writing to a ZB control register when tiling is about to commence) the ZB will break the LDB into two busses 56A, 56B, acting as a slave to PP2 and a master to the FBs. During tiling, PP2 will send starting address and plane equation increment values for each horizontal line segment to the ZB, and the ZB will send pixel data writes and address updates to the FB.

Figure 15:
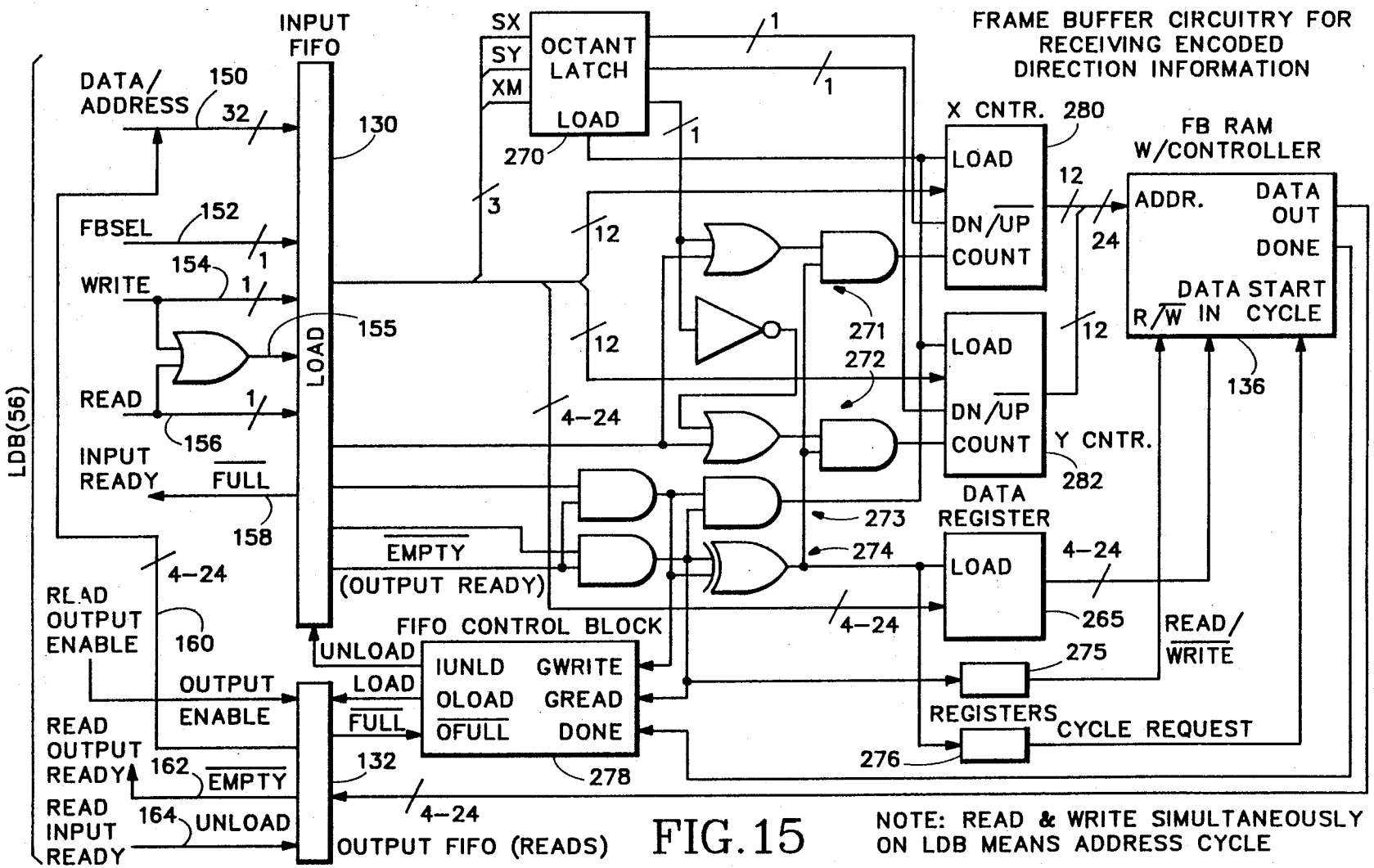
FIG. 15 is a block and logic diagram showing operation of the frame buffer control circuitry for receiving imbedded direction control information and writing pixel data into the frame buffer for display, or reading pixel data from the frame buffer back into off-screen memory, in accordance with the invention.

Referring to FIG. 15 the LDB 56 consists of 32 address/data lines 150 and 7 control lines, not including reset and clock signal lines (not shown). The address/data lines are tristate, but not the control lines. The control line called FBSel 152 selects between two address increment values on the FB and ZB. Read, write and address control signals sent by PP2 (or ZB) are encoded onto two lines 154, 156. The logical OR of the two lines serves as an output ready signal 155 from PP2. The FB sends input ready (IR) signal 158 back to PP2 over an open collector wire-AND'ed line. IR indicates readiness of the input FIFO 130 to accept address, write data, or read commands, by providing a "not-HOLD" signal to upstream FIFOs. Read data travels in the other direction (from FB to PP2) and uses two different handshake signals: Read Output Ready (ROR) 162 and Read Input Ready (RIR) 164. ROR 162 is sent by the FB to PP2 when read data is available in the output FIFO 132. It is an open collector wire-AND'ed line. The FB sets this line (allows it to float high) not only when it has read data available, but also when de-selected. RIR 164 is sent by PP2 to the FB to indicate readiness to accept read data. In addition to the two read handshake signals, there is a third line called Read Output Enable (ROE) 160. This line explicitly controls the output buffer enable of slaves through a one clock delay (i.e., slaves should register this bus line then connect it to their output buffer enable).

Below are some timing examples that will hopefully make the use of these signals more clear. These diagrams are intended to indicate which signals are asserted on which clock cycles, not the delay times within clock cycles. The vertical lines indicate rising (active) clock edges. The space between a pair of vertical lines represents one (74 ns) clock cycle. Signal names are shown on the left side of the diagrams with no reference to the polarity of the corresponding physical bus line. A horizontal line segment is drawn in each clock cycle for which the signal is asserted. Spaces are left where the signal is de-asserted. For the address/data bus a three letter code is used in place of a horizontal line segment to indicate what information is on the bus. Address is indicated by "aaa," the first word of read data by "rdl," the first word . write data by "wdl," and so on. Blanks indicate the high impedance state of the address/data bus. X's indicate a "do not care" state (receivers must ignore, drivers are free to send garbage).

Figure 10A:
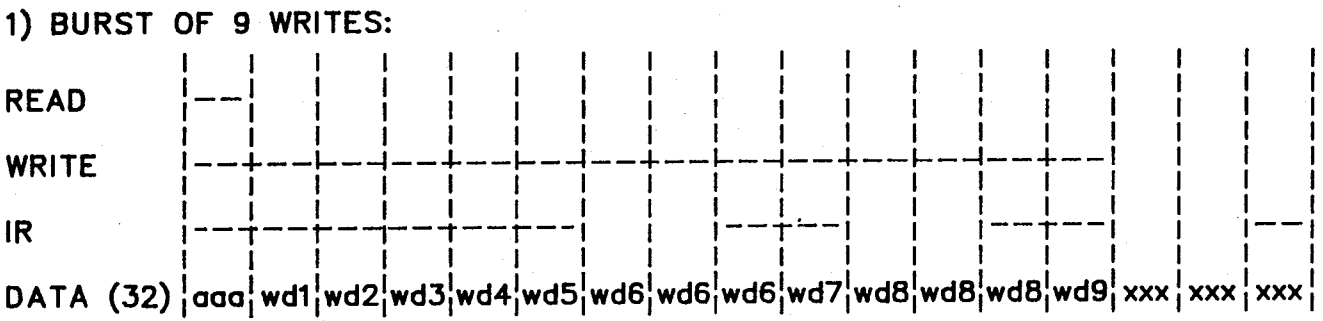

FIG. 10A shows a simple burst of 9 writes. This example might be typical for pixelating a vertical vector. The master (PP2) does an address cycle and then 9 write data cycles. Whenever input ready (IR) is not sent from the FB, PP2 holds the same write data on the bus for the next clock. In this example the FB accepts the first 5 words into its FIFO, then must wait for a memory cycle. After each memory cycle it accepts 2 more words, since 2 pixels of a vertical vector can be written in each memory cycle.

Figure 10B:
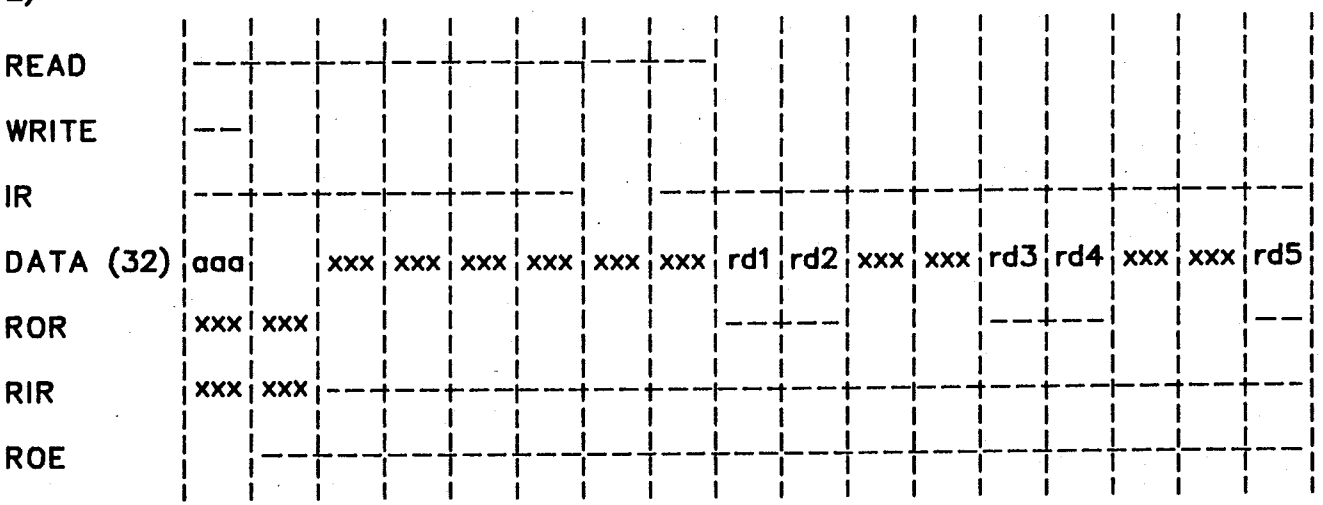

Next, FIG. 10B shows a burst of 6 reads. The IR line from the FB is used to indicate readiness to accept read commands even though no data is passed yet. In this example, the FB buffers 5 read commands, then removes IR until it has room for the 6th. It returns data from the reads in bursts of two (as would happen for a vertical read). PP2 remains always ready to accept the data, so it never removes its read input ready line (RIR). The xxx's on ROR and RIR at the beginning are "do not cares" because of unknown previous state. The first read data word could not possibly be returned before the third cycle even with an infinitely fast slave. The associated handshake lines (ROR and RIR) are thus allowed to be undefined until that point (i.e., through the cycle during which the first read request is sent). This allows slaves (FB) time to determine if they are selected or not. Buffered pass-through boards (ZB) clear their read data FIFO logic on the post-address cycle to eliminate any effects of the unknown control lines. The next example will show what happens when PP2 cannot accept the entire burst of read data at once.

FIG. 10C shows a burst of 4 reads with lower latency. Here, the entire burst of read commands is accepted by the FB at full rate, but PP2 cannot handle the full rate data return. PP2 accepts the first two words, then removes RIR. After two clocks, PP2 is ready for one more word, so it re-asserts RIR. After two more clocks it is ready for another word. After this fourth word, RIR is removed again to indicate that PP2 is not ready for any more words. This time RIR has no effect since no more read data is available. ROE is set at the same time as the first cycle of RD in order to enable the slave's output buffer in case it was ready to return data on the next cycle. ROE is removed as the last word of read data is clocked in by the master.

FIG. 10D shows two reads followed by two writes. To prevent data bus contention, the writes (including the address cycle) must not start until two cycles after ROE is removed. This allows one cycle for the slaves to disable their drivers in response to the disassertion of ROE and a dead cycle on the bus to prevent contention.

FIG. 10E shows slow writes (typical of control register loading). This example shows two writes each with its own address cycle. This is typical of loading control registers on the ZB or FB. Notice that the data cycle does not follow immediately after the address. Such gaps would be permissible in any of the other examples as well. It is also permissible to have gaps in the middle of multiple read or write cycles as shown next.

FIG. 10F shows slow reads. This example shows a slow burst of three reads. Slaves do not need to respond with a known state of ROR until the clock after the first read request (until cycle 5 in this example). Also note that slaves do not drive the data bus until one clock after ROE is set.

LDB Address Map

Next is a description of the address map of the local display bus, followed by a definition of the structure and function of the data communicated over the LDB. The LDB addresses $2^{32}$ words of 32 bits each. No byte or other partial word transfers are supported. Devices using less than 32 bits simply return undefined data (garbage) on the unused lines during reads and ignore the extra bits during writes.

The address space is partitioned into 16 sections of $2^{28}$ words each. The top section is I/O space (bits 31, 30, 29 and 28 are all 1). The bottom section (bits through 28 are all 0's) is frame and Z buffer memory space. The remaining 14 sections in between are reserved for future systems residing on the LDB. Neither the FB nor the ZB responds to these addresses.

The I/O space is further partitioned into 16 slots of $2^{24}$ words each. Each slave LDB board responds to its physical slot address as defined by four slot pins on the backplane connector (not shown). It may also respond to other soft slot addresses if so configured. All soft slot addresses are cleared (disabled) on reset. For hard slots, the I/O space is 1111SSSSaaaaaaaaaaaaaaaaaaaaaa where SSSS is the slot number and the a's represent the remaining 24 address lines available for decoding I/O locations within a given board.

FB and ZB memory space is in binary 0000HXYMyyyyyyyyyyyyxxxxxxxxxxxx where H is a "hesitate" bit (when set this bit indicates no step before the first pixel), X is the X step direction (set indicates right to left), Y is the Y step direction (set indicates top to bottom), M is the Major axis designations bit (set indicates X axis is the major axis), yyyyyyyyyyyy is the initial y position, and xxxxxxxxxxxx is the initial x position. Both frame buffers of a double buffered system, the ZB, and the overlay frame buffer all share this one address space. Each buffer can be enabled and disabled through control registers accessible through I/O space. Accessing any one buffer is accomplished by enabling it and disabling all others.

FBSel is used to control address incrementing during data cycles in memory space. When FBSel is set, both the major and minor axes are stepped before transferring the data. When FBSel is not set, only the major axis is stepped. If the hesitate bit was set in the address cycle, then the first data cycle ignores FBSel and steps neither axis. Further data cycles obey FBSel as usual.

FBSel has an additional meaning to the ZB. During address cycles to memory space, FBSel determines which plane equation increment registers to use. This feature is used in 3D tiling. PP2 sends FBSel during address cycles in which the new X position is the left (smaller) of the two possibilities.

Picture Processor (PP2)

Figure 11:
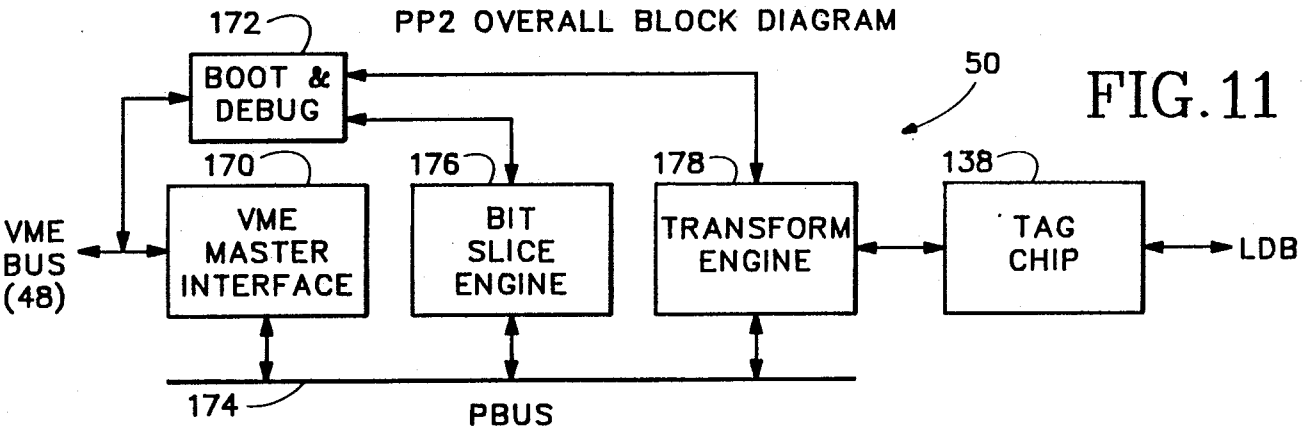
FIG. 11 is an overall block diagram of the picture processor (PP2) used in the graphics pipeline of FIG. 7.

Referring to FIG. 11, the picture processor (PP2) 50 includes a number of functional elements. The PP2 is connected to the VME bus by a VME master interface 170. It also includes boot and debug circuitry 172, also connected to the VME bus. Implementation is largely conventional and not germane to the present invention. Information communicated over the VME bus via the VME master interface 170 is transferred to an internal picture proces r bus (PBUS) 174. This bus is the primary data bus used by bit slice engine 176. Vector or tiling address generator (TAG chip) 138 provides an interface to the local display bus 56. The TAG chip 138 is shown connected to transform engine 178. As further discussed below, information on PBUS 174 can pass through the transform engine 178, without transformation, directly to the local display bus via the TAG chip 138.

Figure 12A:
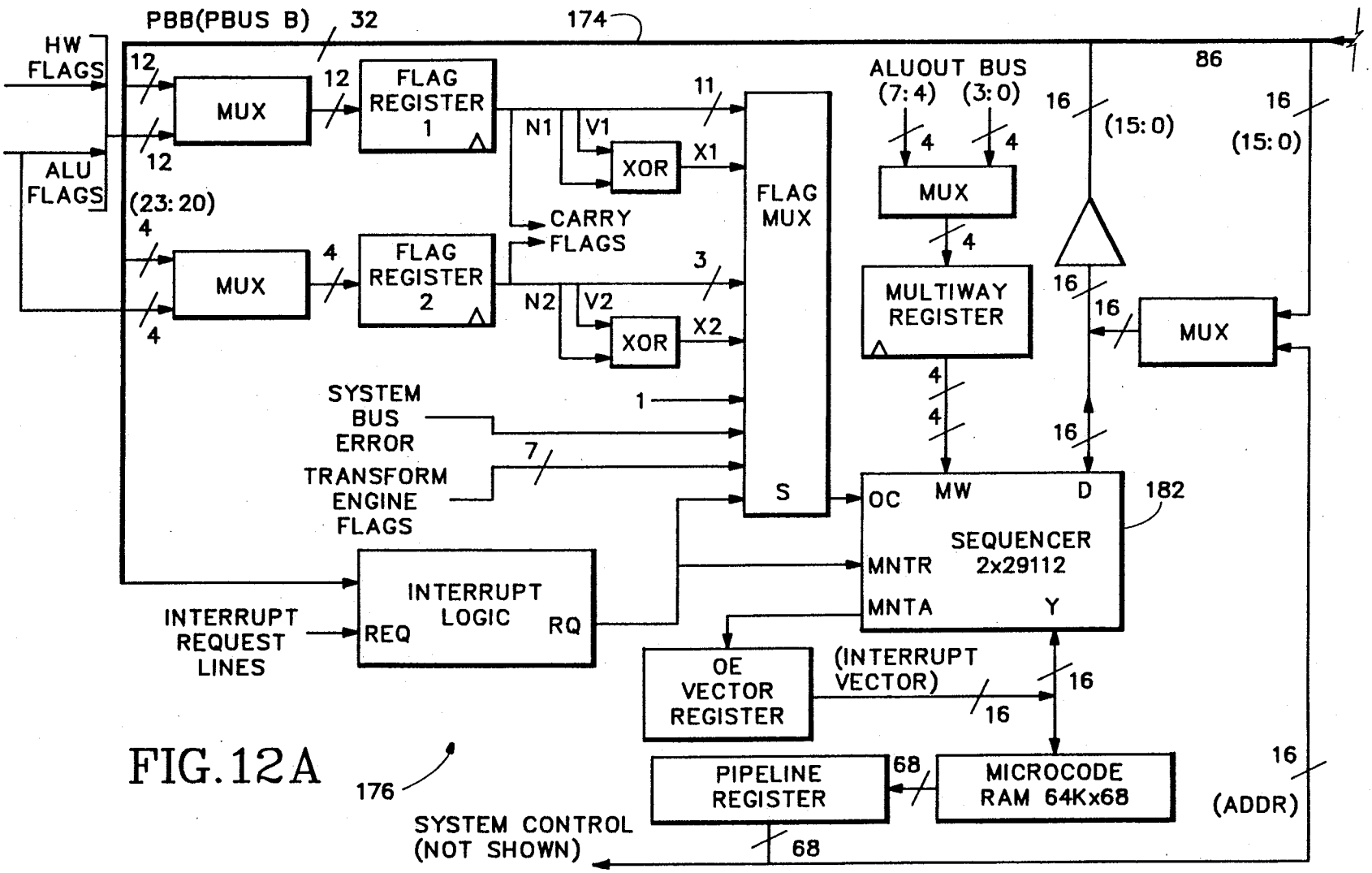
FIGS. 12A, 12B, 12C and 12D are more detailed block diagrams of the picture processor of FIG. 11.
Figure 12A:
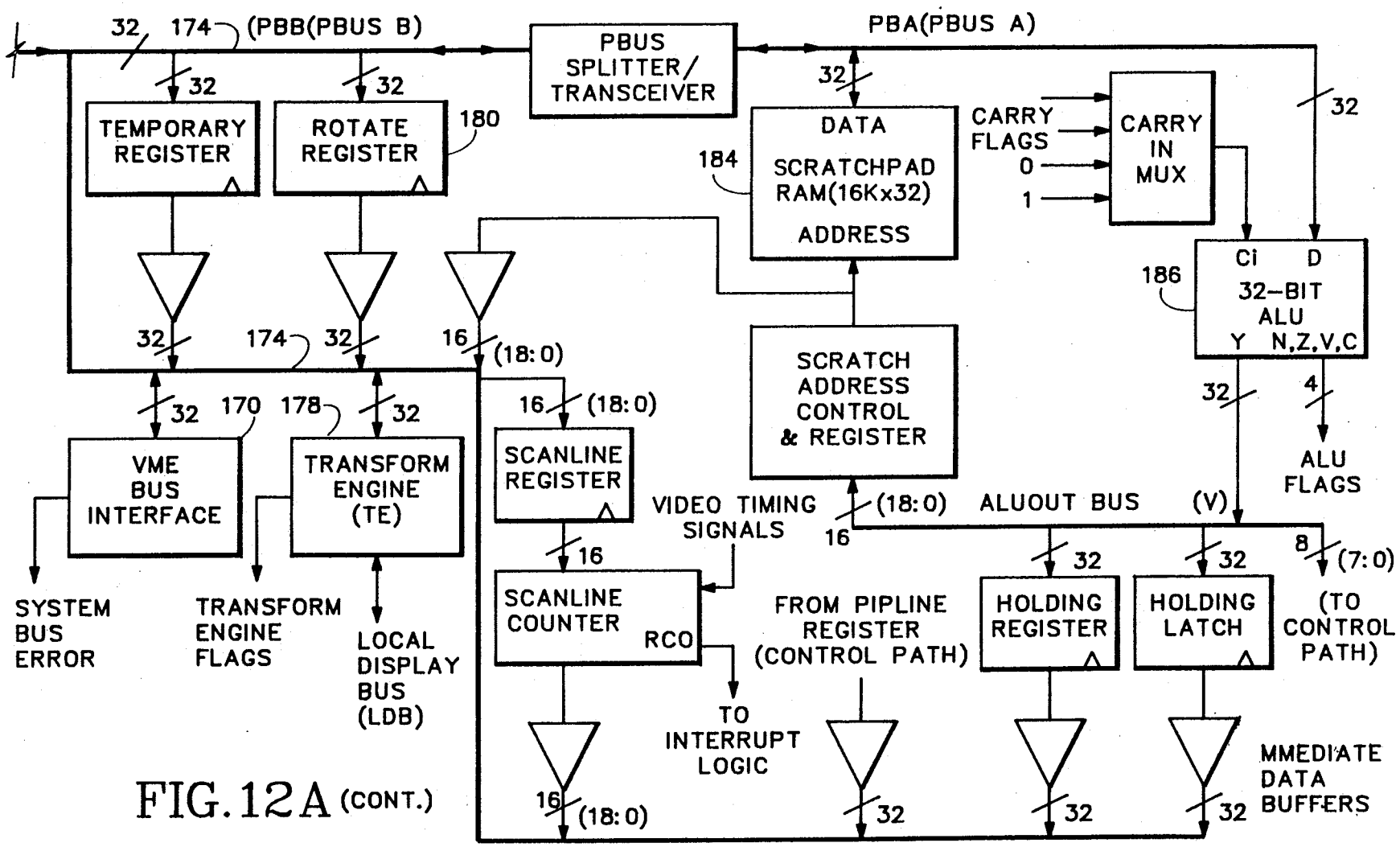
Figure 12B:
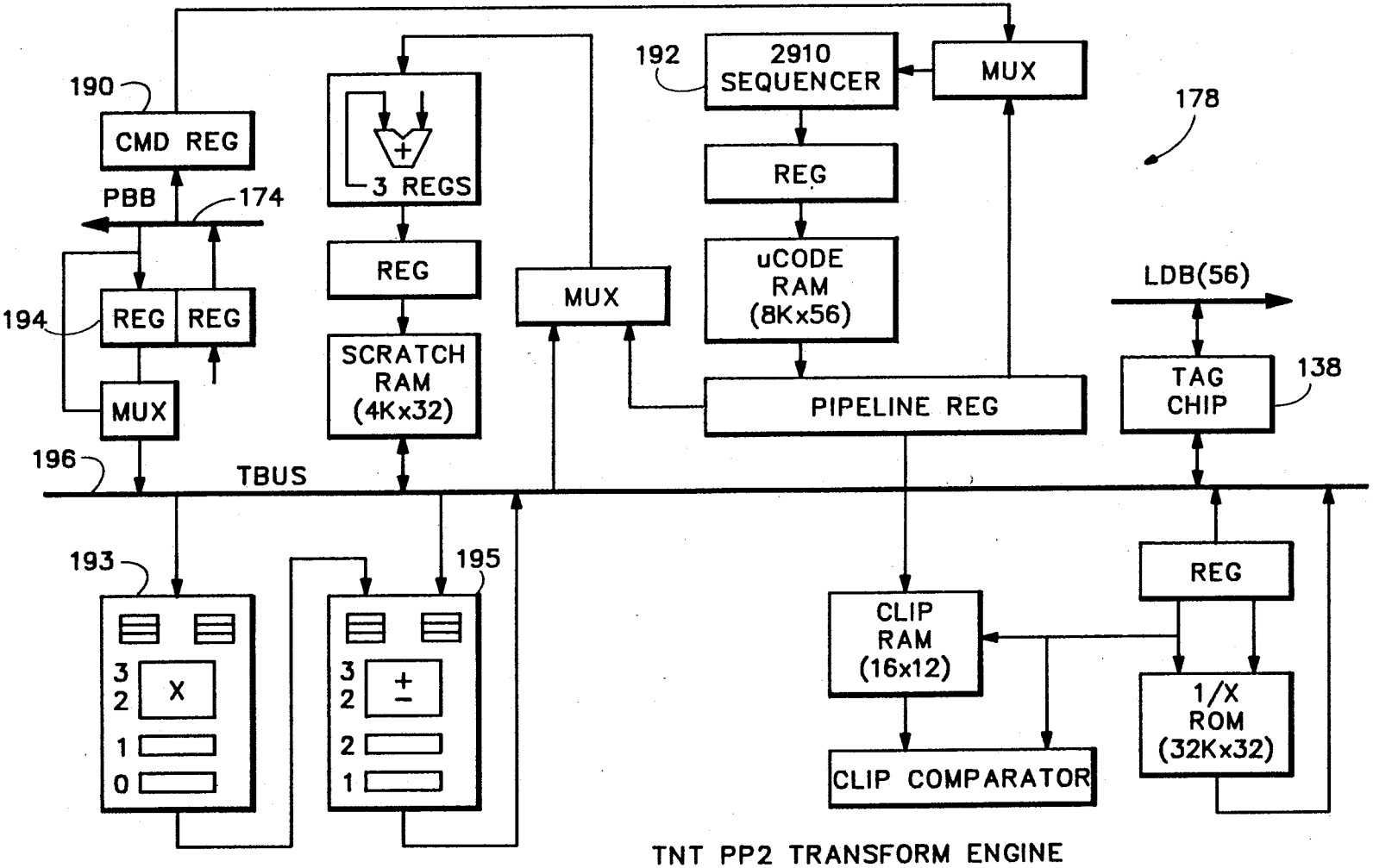
Figure 12C:
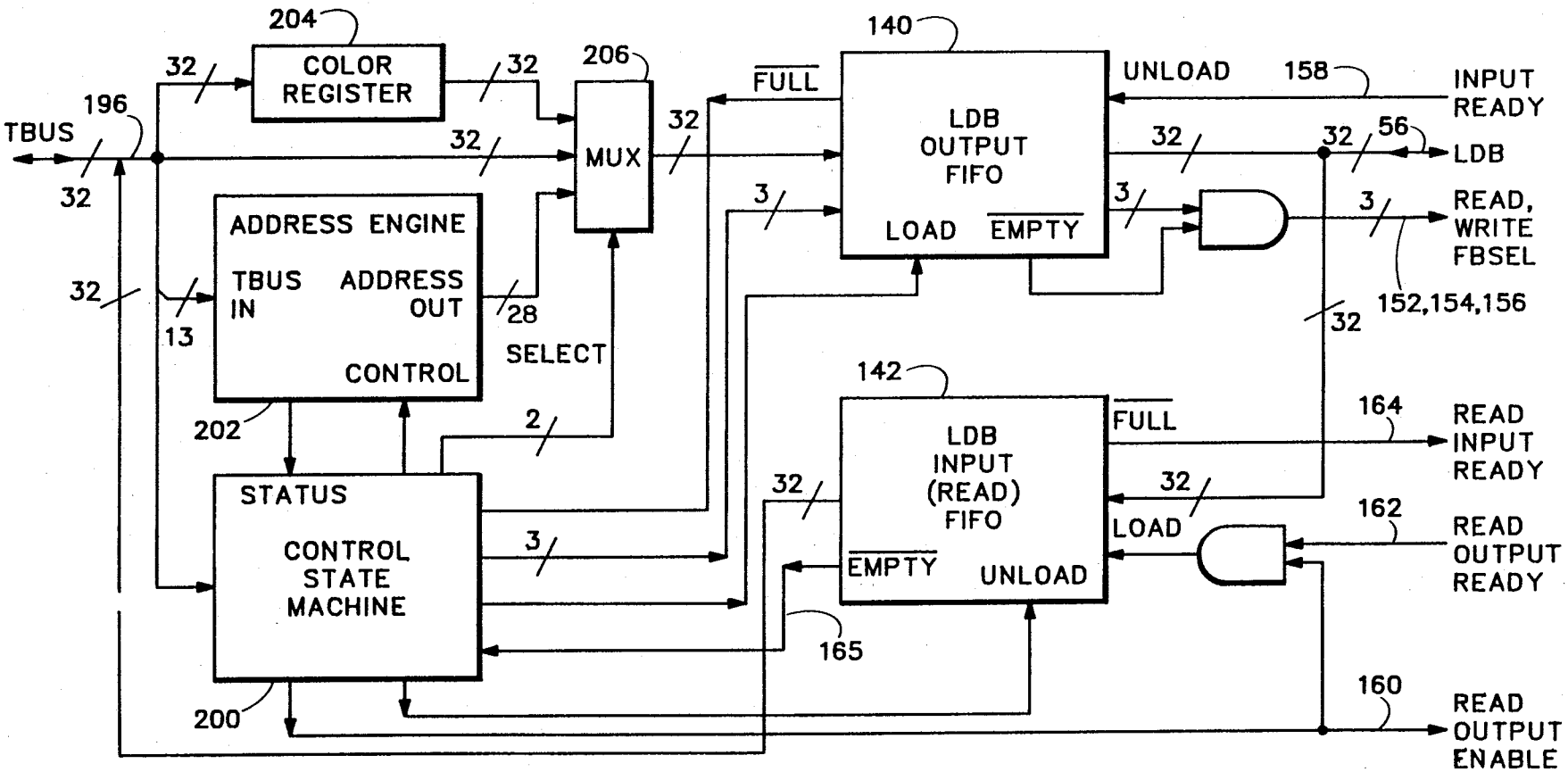
Figure 12D:
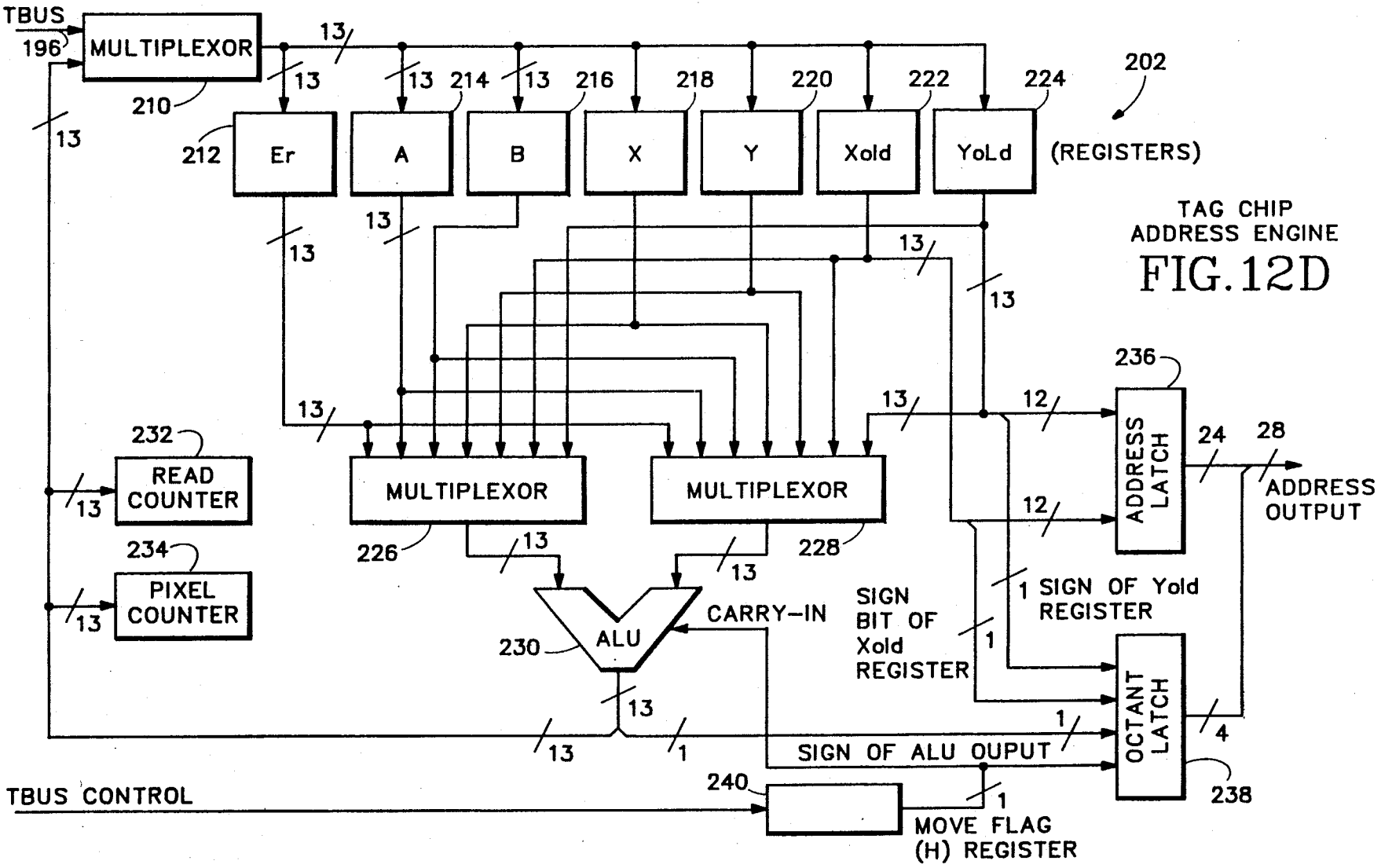

FIG. 12A shows a preferred implementation of a microcode or bit slice engine 176, together with further details of its interconnection to the VME bus interface 170 and the transform engine 178 via the PBUS 174. The general structure and operation of a bit slice engine is known in the art and so is only described in so far as relevant to the present invention.

In operation, the VME bus interface operates under control of a program counter which provides a pointer to the next instruction in the display list to be executed. Following this program counter, the interface fetches each command in turn. As the interface processes each word, it reads it into a rotate register 180, maps off and reads out one byte of the word into a sequencer 182 and stores the remainder of the word in a data scratch pad RAM 184. If the word is an image command, such as a move instruction, this instruction says that the next two 32-bit words are the X and Y coordinates for the first address of a vector. The byte loaded into the sequencer addresses a relative location in a look-up table and an array of instructions that has a jump which is controlled by the byte loaded into the sequencer. It cause the sequencer to branch to a routine that is going to do the move or the first point of a vector. With the control flow of the sequencer at the move instruction, that instruction goes out and reads the next two words from the VME bus interface, continues to chain through the list of instructions in the sequencer, and passes the words to the transform engine 178. If the words are relative coordinates for the starting point of the vector, the bit slice engine executes the appropriate addition or other subtraction in an arithmetic logic unit (ALU) 186. If the words are in a format that does not require ALU processing, they are transferred directly to the transform engine along with a command saying that this is a first point of a vector. If no transform is requested, the transform engine simply passes the vector information to the TAG chip for encoding. The endpoint of the vector is similarly processed and sent to the TAG chip. At this point, the TAG chip has enough data to encode and send the vector to the frame buffer subsystem.

The bit slice engine constitutes a single pipe stage process having a distributed FIFO control which can delay processing if a hold signal is received from the frame buffer or Z-buffer, via similar FIFO controls in the TAG chip and transform engine. When one downstream stage, e.g., the frame buffer, encounters a delay in processing, it sends a hold signal to the next upstream process in the pipeline. That process is stopped from sending further data until the hold signal is removed. When its FIFO fills up, it, in turn, sends a hold signal to the next upstream stage. In this way, after a number of clock cycles corresponding to the number of intervening FIFO stages, processing at the bit slice is held up until a not-hold signal is received.

The bit slice engine processes the vectors that are used for reading, as well as writing in the frame buffer, to carry out Vector Blt operations. It does this by taking the commands (opcodes) and coordinates for vectors from the VME interface, executing the commands to generate output commands and data for the transform engine, which further processes (transforms) the data and outputs the data and commands to the TAG chip for generation of vectors using imbedded direction control. To read a vector in the frame buffer, the bit slice engine will receive a read mode command and transmits this to the TAG chip to put it into read mode for sending subsequent vector address information to the frame buffer subsystem. This time, however, the TAG chip does not send data. It enables the logic circuitry to read frame buffer data, so that pixels stored along the vector are read back along the local display bus to the TAG chip for the bit slice engine to store in off-screen memory. After the entire vector of pixel data stored in the frame buffer has been read, the Vector Blt operation can be used to write new pixel data into the frame buffer locations defined by the same vector.

FIG. 12B shows the transform engine 178 in greater detail, together with its interface along with the TAG chip 138 to local display bus 56. The structure and operation of transform engine 178 is generally known in the art and, an operation being essentially transparent in the context of the present invention, the transform is only briefly described. In general, data enters the transform engine via PBus 174. Transform commands are input to command register 190 and sent to a sequencer 192. Other commands and data can be input either through a register 194, if a transformation is to be performed, or can be bypassed around the register directly to an internal bus (TBus) 196. The transform engine includes a multiplier 193 and an adder 195 controlled by sequencer 192 for performing transforms. Unless they are to be transformed, vector coordinates are passed around register 194 directly to TAG chip 138 across the Tbus. If the vector is to be transformed, an appropriate transform command (opcode) is received by command register 190, and sent to sequencer 192 to control operation of the transform engine in conventional fashion to transform the vector coordinates which were input to register 194, in conventional fashion. The transformed vector coordinates are output to the TAG chip 138.

FIGS. 12C and 12D show the TAG chip 138 in progressively greater detail. Referring first to FIG. 12C the TAG chip interfaces to the Tbus 196 on the left and to the local display bus 56 on the right. Other input and output lines shown on the right side of the diagram correspond to input and output lines shown in the left side of FIG. 15 as identified above. The TAG chip includes a control state machine 200, whose operation in regard to the present invention is further described below which reference to FIGS. 16A, 16B and 16C. The state machine controls an address engine 202 which generates the imbedded vector direction control information. A color register 204 receives and relays color information about pixels to be written into the frame buffer. This information becomes the part of the pixel data which is referred to as the pixel values. Address outputs from the address engine and data outputs from the color register are input to a multiplexer 206, controlled by a select line from the state machine 200, for selectively outputting address and data words to the local display bus output through FIFO 140. The TBus also inputs directly to MUX 206 and is selected for Vector Blt write operations, instead of the color register, to output on the local display bus 56.

The read, write, FBSel, and input ready(IR) control lines 152–158 are likewise output from FIFO 140. The read, write and FBSel bits are input to the FIFO from the state machine 200. The "input ready" is pipelined upstream to control unloading output FIFO 140. The TAG chip also includes input or read FIFO 142, through which pixel data read from the frame buffer is transferred to Tbus 196. The "read output enable" signal is generated by state machine 200. A "read output ready" signal 162 is used to control loading FIFO 142. The "empty" line 165 tells the state machine 200 whether FIFO 142 contains a word to read. A "read input ready" signal line 164 provides a hold or not-hold signal to the output or read FIFO of the frame buffer subsystem.

Referring to FIG. 12D, the TAG chip address engine 202 has an input multiplexer 210 which interfaces to the Tbus 196. The address engine 202 is a hardware implementation of a conventional digital differential analyzer of the type commonly used to implement Bresenham's algorithm or similar vector-drawing algorithm. See for example commonly assigned U.S. patent application Ser. No. 384,081 filed Jul. 24, 1989 which is a continuation of U.S. patent application Ser. No. 079,622, filed Jul. 30, 1987, now abandoned. The address engine includes a series of registers 212–224 to hold the variables used in computing Bresenham's algorithm. These variable are developed in the process shown in the flow chart of FIGS. 16A, 16B, 16C. The outputs of each of these registers are input in parallel to two multiplexers 226, 228, the outputs of which are, in turn, input to an add/subtract ALU 230. The outputs of ALU 230 are input to multiplexer 210 and to both a read counter and pixel counter 232, 234. X and Y addresses are output through address latch 236, to multiplexer 206 (FIG. 12C). A separate octant latch 238 receives and outputs four additional bits to the multiplexer, to provide imbedded vector direction control information. Two of these bits are the sign bits in registers 222, 224, corresponding to the direction in the Y axis and the X axis. The third bit is the sign of the ALU output, which designates the largest component (X or Y) of the vector from beginning to end points as the major axis. The fourth bit is the hesitate bit received from state machine 200 through move flag (H) register 240.

Frame Buffer Control

Figure 13:
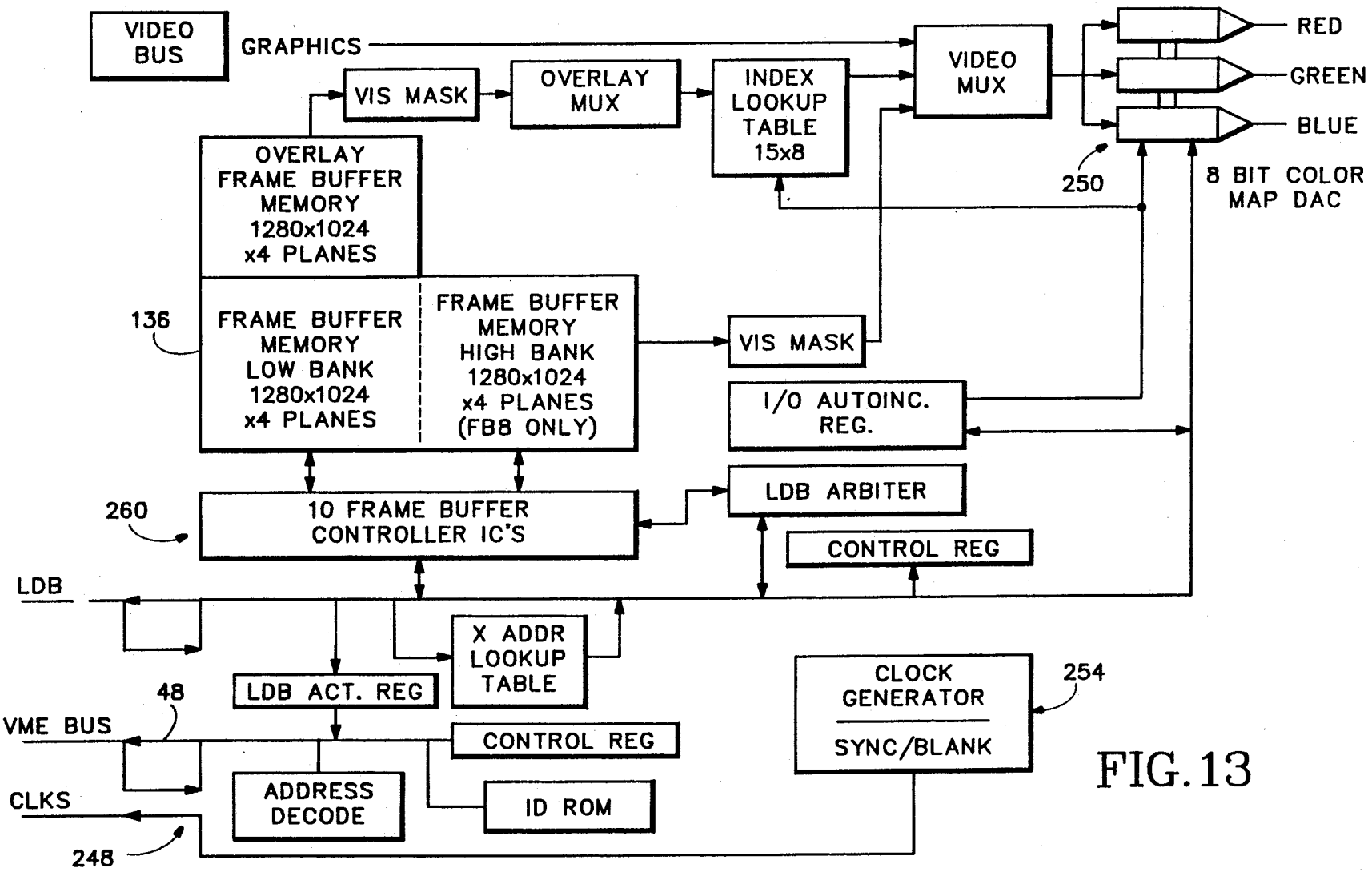
FIG. 13 is an overall block diagram of frame buffer control circuitry for image data storage in the system of FIG. 3.

The frame buffer subsystem 54 and display 58 are designed to provide a high-performance connection to the graphics pipeline and high-resolution, flicker free display. A general block diagram of the FB subsystem is shown in FIG. 13. High system throughput is provided by a flexible frame buffer controller designed to balance single pixel (vector) performance with pixel block transfer operation. The frame buffer organization allows several memory cycles to progress simultaneously on separate sections of memory, so that a vector of random orientation exercises the memory at nearly the maximum available bandwidth. There is no direct connection between the VME system bus and the frame buffers. Thus there is no way for the CP or AE to work directly with the frame buffers as if they were general purpose real memory. Instead, a frame buffer interface 248 supports this capability, which is not further described as it is not pertinent to the invention.

The preferred embodiment uses a 12 plane frame buffer configured as a two board set, one board containing frame buffer memory and associated controllers (FBC chips), while the other board includes color map RAMs, DACs, and related video circuits 250. Timing circuitry 254 is provided to generate appropriate timing signals to drive a 60 Hz, non-interlaced, high-resolution color monitor, and provide all necessary timing signals for the frame buffer and graphic pipeline subsystems.

Each four bit plane frame buffer memory is controlled by a group of gate array, frame buffer controller (FBC) ICs 260. One of FBC 260 is shown in a general block diagram form in FIG. 14. FIG. 15 is a more detailed logic diagram, limited to features pertinent to the invention, showing an alternate implementation of the frame buffer subsystem. Each of these implementations is described in turn, with common elements being identified by like reference numerals.

The FBC 260 provides registers 262,264 for read/-write from the local display bus (LDB) and registers 266 for screen refresh address generation. Resident on the FBC is a small ALU 268 to perform operations on pixel data from/to frame buffer memory 136.

Data and control signals are received and output from the frame buffer controller over the local display bus 56 via input and output FIFOs 130, 132. When a first word containing an address for a beginning point of a vector is received on the multiplexed data/address lines 150 (FIG. 15), X and Y address counters 280, 282 are set to the address contained in the X and Y address portions of the first word. A multiplexer 284 controlled by a bus control state machine 286 inputs the pixel values from the second and subsequent words, following the first word, into data register 264. State machine 286 has, as inputs and outputs, the various signal lines 152–164 (FIG. 15). As the second and subsequent words of pixel data are received, the state machine increments the major axis address counter and, when the FBSel is set, also increments the minor axis counter. The incremented X and Y addresses are input to data register 264 along with the corresponding pixel value.

The address and pixel value data are passed to a latch 267 and passed into an N-deep FIFO 288. This FIFO is controlled by a FIFO control 290, and details of its operation are disclosed in co-pending, commonly assigned U.S. patent application Ser. No. 129,897 filed Nov. 16, 1987 which is a continuation of U.S. patent application Ser. No. 702,982, filed Feb. 19, 1985, now abandoned. Details of this aspect of the system are not germane to the present invention and are not further described.

Pixel data is then output to a memory interface section which includes conventional circuitry 292 for accessing the frame buffer locations indicated by the address portion of the pixel data and data output circuitry 294, which includes ALU 268, which writes the pixel values in the addressed locations of frame buffer. The data circuitry also includes a register 296 into which pixel data is input from the frame buffer when a read operation is performed.

FIG. 15 implements the foregoing aspects of the invention using hard logic rather than a state machine. Many features shown in FIG. 15 have already been described, such as the LDB structure (lines 150–164), FIFOS 130,132, frame buffer memory 136 and the X and Y address counters 280, 282.

An octant latch 270 receives and stores the imbedded vector direction control information sent in the first, address word of each vector. The latch has X and Y direction outputs to the address counters to control whether they count up or down from the beginning point address. The major axis bit is output to a set of gates 271, 272 that determine which of the counters (the major axis cou ter) is to be incremented (or decremented) upon each subsequent "read" or "write" signal (lines 156, 154). The read and write signals are input to another set of gates 273, 274 which provide an output to each counter for incrementing (or decrementing) the major axis counter and, if the FBSel line 152 is set, also to increment (or decrement) the minor axis counter. If both the "read" and "write" lines are set (line 155), this indicates an address cycle and logic 271–274 provides a "load" signal to the counters to input new X and Y addresses.

Figure 14:
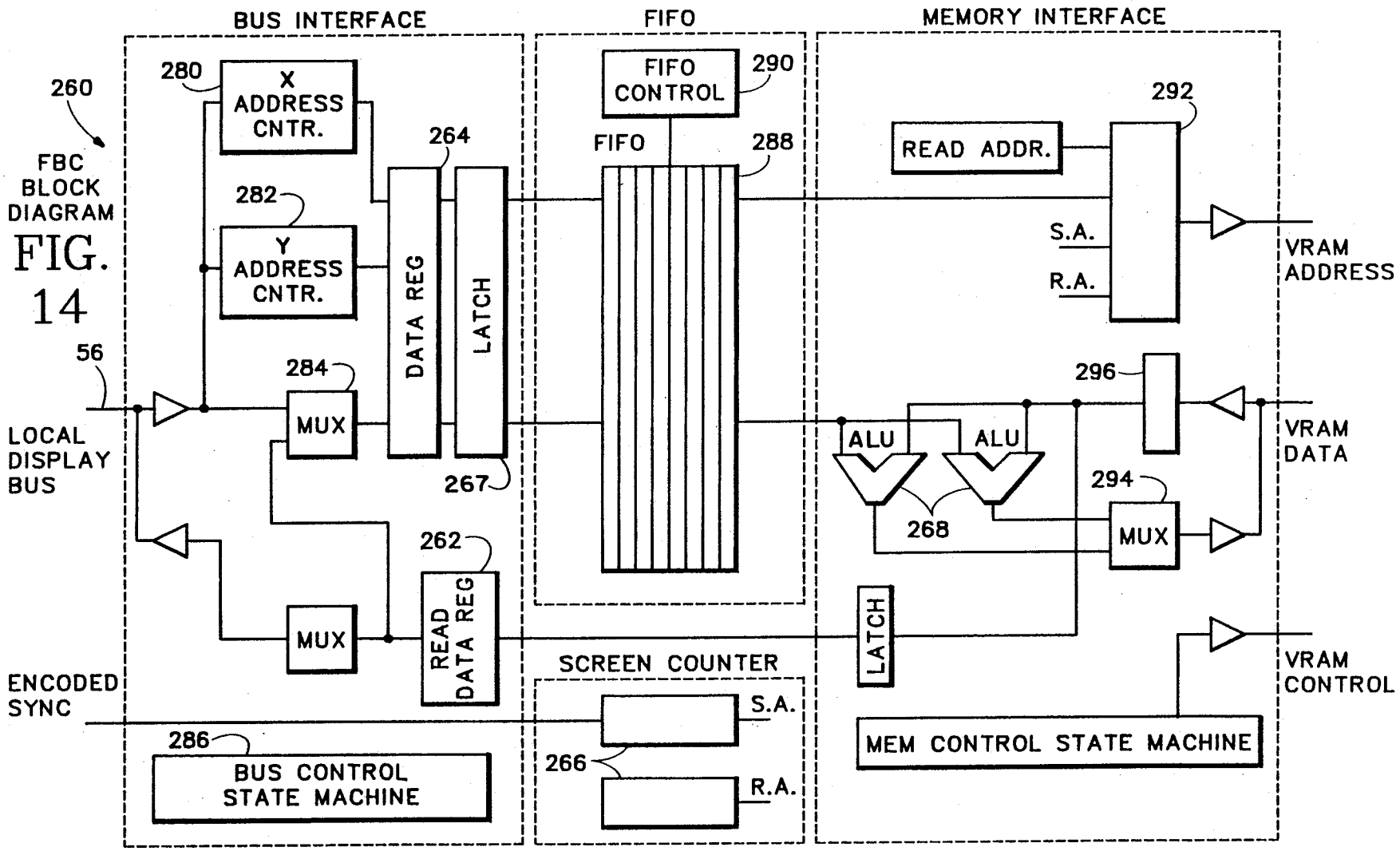
FIG. 14 is a more detailed block diagram of a preferred implementation of the frame buffer controller used in the circuitry of FIG. 13.

Data register 265 corresponds to the lower portion of register 264 in FIG. 14 and outputs pixel values to the frame buffer memory 136 when addresses are output from the address counters, if the "read/not write" line is set low. This line is controlled by line 156 through the first (OR gate) stage of logic 274 and a register 275. When this line is set high, pixel values are read from the frame buffer and sent via a data out line to output FIFO 132. A "cycle request" line from the output of gates 274 is input to the frame buffer start cycle control via register 276.

Both the input and output FIFOs are controlled by a FIFO control block 278. Following are the logic equations that govern its operation:

IUnload = GRead and GWrite or GRead and Done and notOFull or GWrite and Done

OLoad = GRead and notGWrite and Done and notOFull

This block controls the unloading of data from the input FIFO during write operations and the loading of data into the output FIFO during read operations.

Imbedded Vector Direction Control Process

Figure 16A:
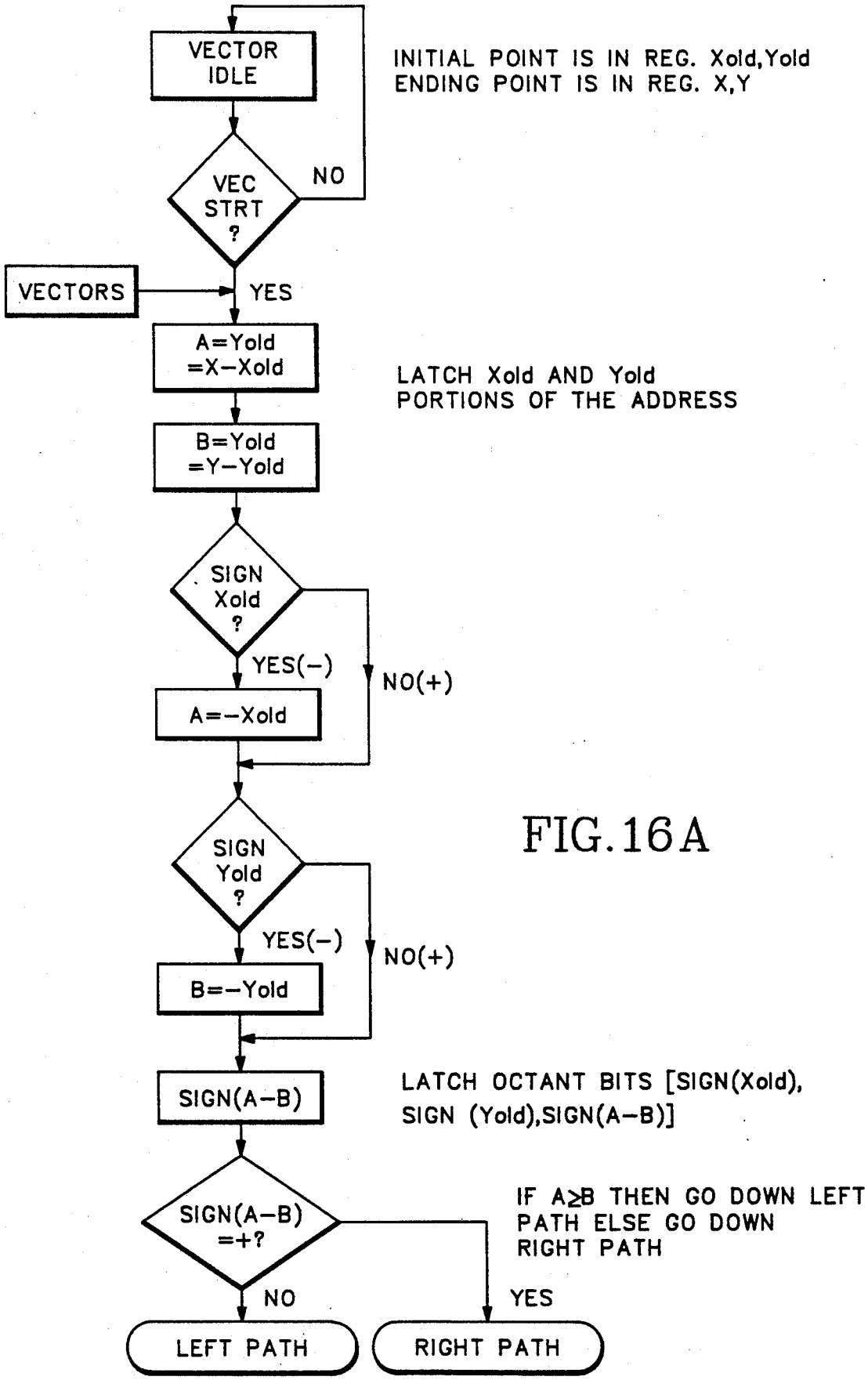
FIGS. 16A, 16B and 16C are a flow chart of the process for operating the processor of FIG. 12C to generate and send imbedded direction control information to operate the circuitry of FIG. 15.
Figure 16B:
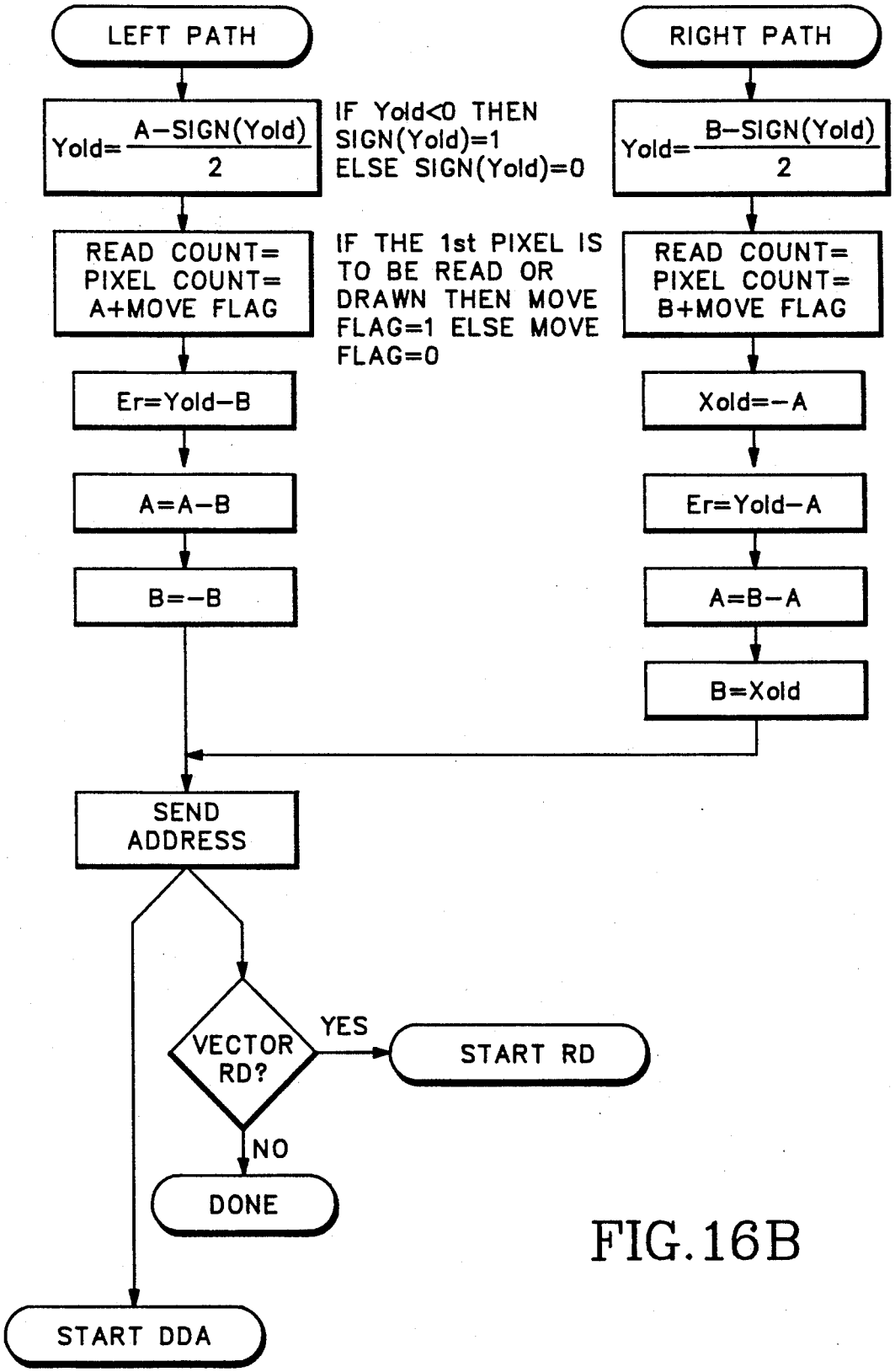
Figure 16C:
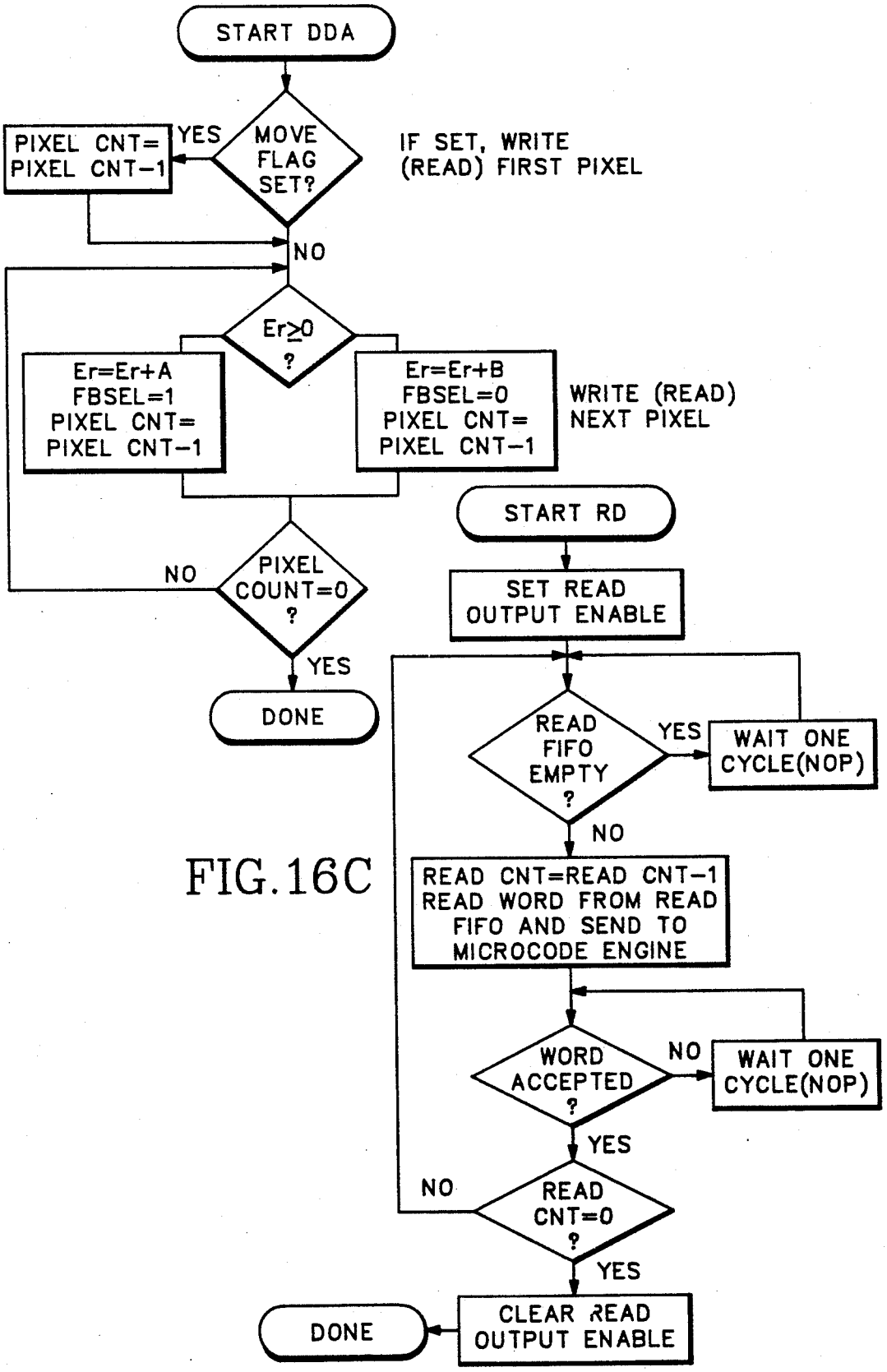

FIGS. 16A, 16B and 16C show the process by which the control state machine 200 and address engine 202 (FIG. 12C) implement the imbedded vector direction control protocol to write or read pixel data along vectors in the frame buffer.

The portion of the process shown in FIG. 16A receives input vector and, from the vector's beginning and end points, determines which axis is to be the major axis and the direction (plus or minus) of the X and Y components of the vector from its beginning point. The initial point is placed in registers XOLD, YOLD. The ending point is placed in registers X, Y. These registers are shown in FIG. 12D. The first step is to latch the XOLD and YOLD data, defining the beginning point of the vector, to save as the beginning point address in address latch 236 (FIG. 12D). Next, the differences between the beginning and end points are computed along each of the X and Y axes to determine the sign of direction of movement from the beginning point. Also, the difference in magnitude of the vector X and Y components is determined and the longer component axis is selected as the major axis.

Preparatory to proceeding to the next subprocess, shown in FIG. 16B, the process branches into a left path and a right path. The left path is slightly more efficient than the right path and is selected whenever the magnitude of the X component of the vector is greater than or equal to that of the Y component. The last step in the portion of the process shown in FIG. 16A is to latch the octant bits, the X axis direction, Y axis direction and the selected major axis, into octant latch 238 (FIG. 12D).

Referring to FIG. 16B, whichever path is selected that path computes the Bresenham algorithm variables in registers 212–224 for subsequent computations by ALU 230 in determining subsequent address locations along the vector. Additionally, a bit called "move flag," which indicates whether the first pixel in a vector is to be read or drawn, is added to the pixel and read count for the major axis component. The "move flag" bit is set by the bit slice engine in response to a "move" opcode. This bit is also transferred through register 240 to a fourth bit-position in octant latch 238 to serve as the hesitate bit. The remaining steps in the left and right path of FIG. 16B are known in the art and need not be further described.

The last step in this subprocess is to send the beginning address and octant latch contents, start the differential digital analyzer (DDA) subprocess and, depending on whether the operation is to be a vector write or vector read operation, to fork the process. The left prong of the fork starts the DDA, which process is shown on the left side of FIG. 16C. The right prong of the fork proceeds to a decision whether the operation is a vector read, rather than a vector write. If not, then this process ends and operation of the DDA process is carried out as a vector write. If it is a vector read operation, then this prong of the fork proceeds to the read procedure shown on the right side of FIG. 16C.

The DDA procedure shown on the left side of FIG. 16C is carried out whether the operation is a vector write or vector read. Essentially, this subprocess executes Bresenham's algorithm to determine where each succeeding pixel in a vector is to be written or read. First, however, it determines from the "move flag" or hesitate bit whether to write or read the first pixel, corresponding to the beginning point of the current vector. This is used (i.e. not set) if the current vector has a beginning point which coincides with the end point of a preceding vector, to prevent such pixel from being overwritten or read a second time. It is not set when the first pixel is to be drawn or read. The DDA subprocess continues for each step along the major axis until the end point of the vector is reached (pixel count = zero).

If the operation is a vector read, the subprocess on the right side of FIG. 16C commences with a step which sets the signal lines to enable output data to be read from the frame buffer along the vector traced by the subprocess on the left side of FIG. 16C. The next step is to determine whether or not the read FIFO is empty. It usually takes several cycles for the first pixel value to be read from the frame buffer into the read FIFO. The subprocess loops until this occurs. Then, the subprocess decrements the read counter, reads the first word from the read FIFO, and sends it to microcode engine. The subprocess then tests to see if the word has been accepted by the microcode engine. If not, in case of a delay in the pipeline, the subprocess waits one cycle and tests again. Once the word has been accepted, the process loops back to the beginning, checks for presence of the next word in the read FIFO, decrements the read counter and sends the word back to the microcode engine. This proceeds for each succeeding word along the vector until the end point of the vector is reached. Then, the subprocess clears the read output enable and ends.

For a normal vector draw operation (notread), the DDA process sets the LDB write line and outputs the pixel value on the LDB data lines. The FBSel line is set or not, as determined in the process in the left hand side of FIG. 16C, to determine where in the frame buffer the pixel value stored. It is stored at either the next step along the major axis or at a diagonal step corresponding to steps along both the major and minor axes, in the direction indicated by the octant data. The pixel value comes from the previously loaded color registers.

For example, the invention can be used to draw an octagon on the display. Each segment of the octagon is defined as a vector having a beginning and end point. Each vector is drawn in turn, commencing from a starting point of a first vector and continuing into the end point of a last vector which closes the geometric figure. At each vertex of the octagon, new octant information is sent to change one or more of the octant bits as needed to change the direction for the next vector. A circle can be similarly drawn. Conventional practice is to approximate a circle by a series of short line segments, sending a new address at the beginning of each short line segment. In the present invention, however, a circle can be drawn based upon the above-described octagon by extending the definition of a vector to include a segment of an arc. A new address need be sent only when the change in slope of the arc would fall outside a range of zero degrees to forty-five degrees from the major axis in the minor axis direction. These principles can be extended to arbitrary curves as well.

Vector Blt Mode

Figure 18:
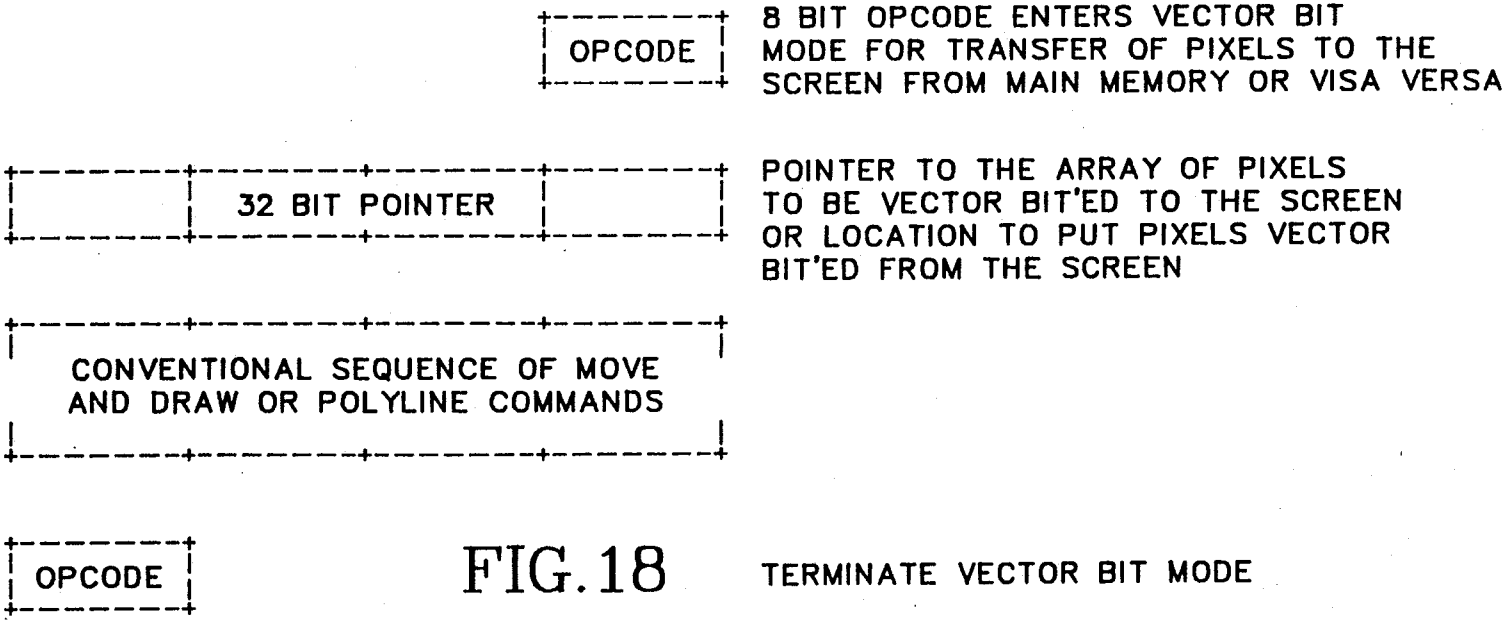
FIG. 18 is a diagram of the instruction process used for writing vectors into the frame buffer and display while saving the overwritten information for restoration to the frame buffer and display.

Referring to FIG. 18, a Vector Blt operation is initiated by the presence of an 8-bit opcode in the display list which causes the microcode engine to run the Vector Blt write or read procedures described above. The command structure includes a pointer to the off-screen memory location of the array of pixels to be written to the frame buffer along the vector or to which pixels read from the frame buffer along the vector are to be stored. This is followed by a conventional sequence of move, draw or read commands which define the beginning and endpoints of the vectors along which the write or read is to be performed.

If an octagon or circle or other vector-defined figure is to be placed only temporarily on the screen, the vectors are traversed twice. First, a Vector Blt read is performed to save the prior pixel values along the vector from the frame buffer to off-screen memory. Second, a vector draw is performed along the same set of vectors to write the new, vector-defined figure into the frame buffer for display on the screen. When the figure is to be removed or moved, a Vector Blt write procedure is called to restore the previously stored data back to the frame buffer, overwriting the stored figure pixels. Each of these Vector Blt operations transfers pixel values between the main memory and the frame buffer, over the TBus. Each Vector Blt operation ends with an opcode that terminates the Vector Blt mode.

Distributed FIFO Control

Figure 9:
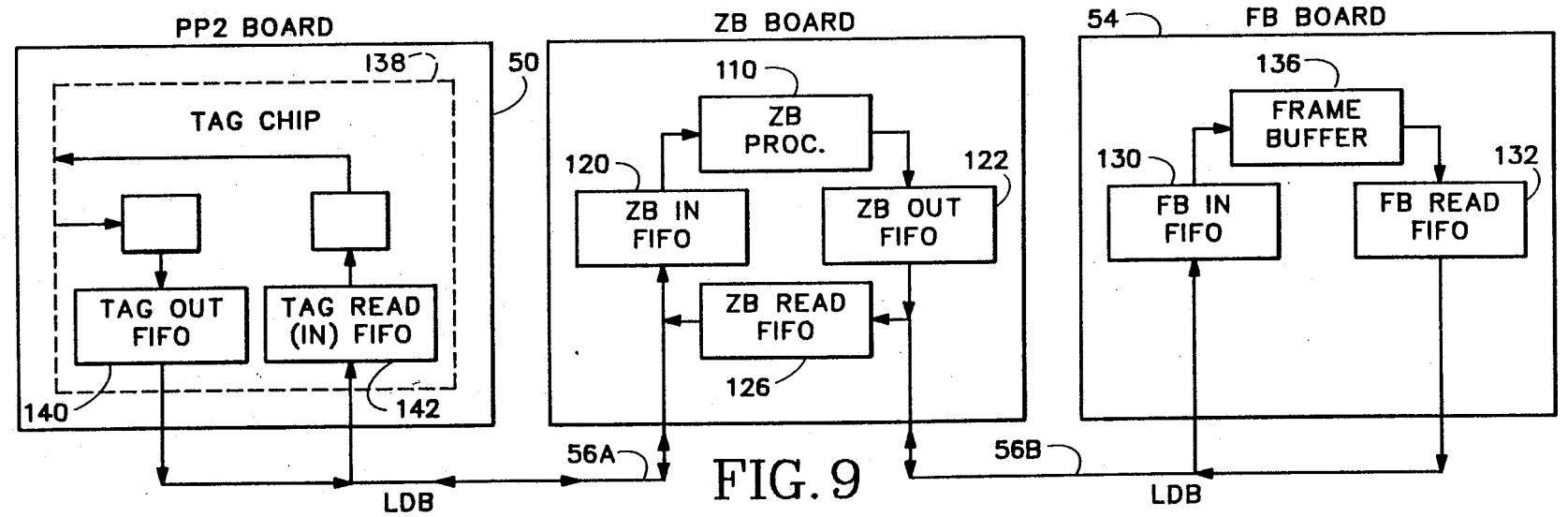
FIG. 9 is a more detailed block diagram of the local display bus portion of the graphics pipeline of FIG. 7.

FIG. 17 illustrates the principles of the distributed FIFO pipelining structure and method. It allows a pipeline to be easily expanded without affecting performance, even if the pipe stages have different or varying processing times. This is accomplished by distributing a first in, first out (FIFO) among the pipe stages, as shown in FIG. 9. A transparent latch 300, 301 is added in front of each pipe stage and acts as a one-deep FIFO at the input of each pipe stage process 302, 304. Alternatively, a transparent latch and a register (not shown) can be used in tandem to act as a two deep (or greater) FIFO. Each pipe stage also has an output register 306, 308. The FIFO is used to store the data being sent from the previous or upstream stage when the current stage is not ready to receive it. A control register 310, 311, clocked by the pipeline clock (line 312), is also added to each stage to latch the current hold (IR) signal (line 315), sent from a following or downstream stage (not shown), before the next hold signal (line 314) is sent to the previous or upstream stage. The hold signal input to the control register at each stage is ORed with a busy signal from its own stage so that the next, upstream hold signal (line 314) is set when either or both the downstream hold signal (line 315) or the busy signal (line 317) is set.

For convenience, the current stage 301 is denoted as stage n. The previous or upstream stage 300 is denoted n−1 and the following or downstream stage (not shown) as n+1. As long as pipe stage n is ready for new data, it does not generate a "busy n" signal (line 317) and, therefore, no "hold n" signal is sent up the pipe control line 314 during the next clock cycle. If pipe stage n is not ready for new data, it generates a "busy n" signal. The "busy n" signal is latched in register n at the end of the clock cycle and generates a "hold n" signal on line 314. The presence of the "hold n" signal causes latch n (301) to hold the data from the previous clock cycle and signals pipe stage n−1 (302) to continue sending the current data until the "hold n" signal is taken away. The presence of the "hold n" signal causes a "hold n−1" signal to be generated on line 313 during the following clock cycle as the process of latching the data and transmitting the hold signals continues up the pipeline. In effect, then, the hold signals are pipelined in the opposite direction as the data.

Having described and illustrated the principles of our invention in a preferred embodiment thereof, it should be apparent to those skilled in the art that the invention may be modified in arrangement and detail without departing from such principles. We claim all modifications coming within the scope and spirit of the following claims.

We claim:

1. A raster scan image-generating system comprising:

graphic data generating means for generating graphic commands to define images for display;

raster scan display means for visually displaying the graphic data in a series of parallel raster lines, each line including a series of pixels;

processing means for transforming the graphic commands into pixel data including an address and a value of each pixel;

frame buffer means including at least one plane of memory elements corresponding dimensionally to the raster lines and pixels of the display means for storing the pixel data and outputting the pixel values to the display means one raster line at a time and one pixel at a time in each line; and frame buffer control means connected to receive the pixel data from the processing means for controlling the manner in which the pixel data is stored in the frame buffer;

the processing means including:

means for generating a vector having at least a beginning point and a direction;

means for generating first and second pixel data for said vector including at a first address for a first pixel corresponding to said beginning point and an incremental octal position and pixel value for a second pixel adjacent the beginning point pixel; and means for sending said first and second pixel data to the control means in a first word and a second word, the first word comprising said first address and a first bit defining a selected one of the X-axis and the Y-axis as a major axis and a second bit defining a direction along the selected axis from the first address toward the second pixel, and the second word comprising the pixel value for the second pixel and a minor axis bit defining whether or not the second pixel is positioned at a second address laterally adjacent the major axis on the non-selected, minor axis; and the control means including means responsive to the first word for addressing the first address location in the frame buffer in accordance with the first address and setting a direction of incremental movement along the selected major axis in accordance with the first and second bits;

means responsive to the second word for moving incrementally from the first address location along the major axis in accordance with the set direction of incremental movement and along the minor axis in accordance with the minor axis bit to a second address location; and means for writing the second pixel value in the second address location.

2. A system according to claim 1 in which:

the first word includes a third bit defining a direction along the non-selected, minor axis and the control means responsive to the first word is responsive to the third bit to set a direction for incremental movement along the minor axis; and the minor axis bit is a single bit indicating whether or not to increment along the minor axis and the control means responsive to the second word causes movement in accordance with the set minor axis direction and the minor axis bit.

3. A system according to claim 1 in which the processing and control means are operable to send, receive and write into the frame buffer means a pixel value for the first pixel in the first address location of the frame buffer means.

4. A system according to claim 1 in which the means for generating a vector having at least a beginning point and a direction is further operable to generate a second vector having a second beginning point corresponding to an endpoint of a preceding, first vector;

the processing means being operable to send to the control means a pixel value for the first pixel corresponding to the beginning point of each said vector;

the processing and control means including means for sending and receiving a hesitate bit; and the control means being responsive to the hesitate bit to determine whether or not to write the first pixel value in the first address location of the frame buffer means so as to control whether a first pixel value of the second vector overwrites a last pixel value corresponding to the endpoint of the first vector.

5. A system according to claim 1 in which the vector generating means is operable to generate a curve.

6. A system according to claim 5 in which the processing means is operable to interrupt sending said second word for points along a first line or curve in a first octant, to send another first word containing a second set of said first and second bits for changing one of said major axis or direction, and to resume sending said second words to generate a second line or curve in a second octant.

7. A system according to claim 1 including:

off-screen memory means for storing the graphic images;

means for reading pixel data from the frame buffer means into the off-screen memory means; and means for restoring pixel data from the off-screen memory means to the frame buffer means.

8. A system according to claim 7 in which the processing means and the control means are cooperative with at least one of the restoring means and the reading means for transferring pixel data between the frame buffer means and off-screen memory means by use of said first word and the minor axis bit portion of the second words.

9. A system according to claim 7 in which the processing means and the control means are cooperative with the restoring means and the reading means for transferring pixel data between the frame buffer means and off-screen memory means by use of said first word and the minor axis bit portion of the second words.

10. A system according to claim 1 including:

off-display memory means for storing the graphic images; and means cooperative with the processing means and the control means for reading pixel data from the frame buffer means into the off-display memory means by use of said first word and the minor axis bit portion of the second words.

11. Apparatus for controlling a raster scan display device for visually displaying graphic images in a series of parallel raster lines, each line including a series of pixels, comprising:

processing means for receiving and transforming graphic commands into pixel data including an address and a value of each pixel;

frame buffer means for storing the pixel data and outputting the pixel values to the display device one raster line at a time and one pixel at a time in each line;

multiplexed address/data bus means for transmitting pixel data between the processing means and the frame buffer means; and frame buffer means for controlling storage of the pixel data in the frame buffer means;

the processing means including:

means responsive to a predetermined graphic command for generating a vector having at least a beginning point and a direction;

means for generating first and second pixel data for said vector including a first address for a first pixel corresponding to said beginning point and an incremental octal position and pixel value for a second pixel adjacent the beginning point pixel; and means for sending said first and second pixel data to the control means in a first word and a second word, the first word comprising said first address and a first bit defining a selected one of the X-axis and the Y-axis as a major axis, a second bit defining a direction along the X-axis and a third bit defining a direction along the Y-axis from the first address toward the second pixel, the axis non-selected by the first bit defining a minor axis and the corresponding one of the second and third bits defining a minor axis direction; and the second word comprising a single minor axis bit defining whether or not the second pixel is positioned along the non-selected, minor axis in said minor axis direction at a second address corresponding to the incremental octal position of the second pixel relative to the first pixel address; and the control means including means responsive to the first word for addressing the first address location in the frame buffer in accordance with the first address and setting a direction of incremental movement along the selected major axis in accordance with the one of the first and second bits that corresponds to the selected major axis; and means responsive to the second word for moving incrementally from the first address location along the major axis in accordance with the set direction of incremental movement and along the minor axis in the minor axis direction as determined by the minor axis bit to a second address location.

12. Apparatus according to claim 11 including means for selectably writing or reading pixel values into or out of the addressed frame buffer address locations successively upon receipt of each second word, the multiplexed bus means being operative for writing by including the pixel value for each pixel in the second word and operative for reading by omitting pixel values from the second word for pixel values read from the frame buffer to be transmitted to the processing means.

13. Apparatus according to claim 12 including means for generating and transmitting a hesitate bit from the processing means via the bus means, the frame buffer control means being selectively responsive to the hesitate bit to write or read a pixel value at the first address location.

14. Apparatus according to claim 12 including:

off-display memory means in communication with the processing means for storing portions of the graphic images; and means cooperative with the processing means and the control means for reading pixel data via the bus means from the frame buffer means along a vector by use of said first and second words into the off-display memory means.

15. Apparatus according to claim 11 in which the processing means and frame buffer means are configured as successive pipe stages in a pipeline along the bus means, each pipe stage including distributed first-in first-out (FIFO) means responsive to a clock signal for transmitting said words through a first, upstream pipe stage to a second, downstream pipe stage and responsive jointly to the clock signal and a hold signal from the downstream stage for holding said words until the hold signal is removed, and means responsive to the clock signal for pipelining the hold signals from the downstream pipe stage to the upstream pipe stage.

16. A method for transmitting graphic data in the form of pixel data including an address and a value of each pixel between a picture processor and a frame buffer in a raster scan display, the frame buffer including at least one plane of memory elements for storing the pixel values at their respective addresses and for outputting the pixel data to the display one raster line at a time and one pixel at a time in each line, the method comprising:

generating a vector having at least a beginning point and a direction;

generating in the picture processor first and second pixel data for said vector including a first address for a first pixel corresponding to said beginning point and an incremental octal position and pixel value for a second pixel adjacent the beginning point pixel;

encoding said first and second pixel data in a first word and a second word, the first word comprising said first address and a first bit defining a selected one of the X-axis and the Y-axis as a major axis and a second bit defining a direction along the selected axis from the first address toward the second pixel, and the second word comprising a minor axis bit which determines whether or not the second pixel is positioned at a second address laterally adjacent the major axis on the non-selected, minor axis;

sending the first word and the second word to the frame buffer;

decoding first word, addressing the first address location in the frame buffer in accordance with the first address, and setting a direction of incremental movement along the selected major axis in accordance with the first and second bits;

decoding the second word and moving incrementally from the first address location along the major axis in accordance with the set direction of incremental movement and along the minor axis as determined by the minor axis bit to a second address location; and reading or writing a second pixel value in the second address location.

17. A method according to claim 16 in which:

encoding the first word includes encoding a third bit defining a direction along the non-selected, minor axis and decoding the first word includes setting a direction for incremental movement along the minor axis in accordance with the third bit; and encoding the second word includes encoding the minor axis bit as a single bit indicating whether or not to increment along the minor axis and decoding the second word causes movement in accordance with the set minor axis direction as determined by the minor axis bit.

18. A method according to claim 16 including:

encoding in the first word a hesitate bit which indicates whether or not to read or write a pixel value for the first pixel in the first address location of the frame buffer; and decoding the first word includes reading or writing the pixel value for the first pixel in the first address location or not as determined by the hesitate bit and writing the pixel value for the second pixel in the second address location.

19. A method according to claim 16 including;

generating a first said vector which includes an endpoint and generating a second said vector having a second beginning point corresponding to the endpoint of the first vector and a different direction;

encoding, sending and decoding the first said vector including the beginning point and a first direction in one said first words and successive points thereof including the endpoint in a plurality of said second words;

subsequently encoding, sending and decoding the second said vector including the beginning point and a second direction in one said first words and successive points thereof in a plurality of said second words; and reading or writing a pixel value at each point along each vector.

20. A method according to claim 19 including:

encoding in the first word a hesitate bit which indicates whether or not to write a pixel value for the first pixel in the first address location of the frame buffer; and encoding the hesitate bit of the first word for the second vector to indicate not to read or write the first pixel value in the first address location of the frame buffer so that the first pixel value of the second vector is not read or written over a last pixel value corresponding to the endpoint of the first vector.

21. A method according to claim 16 in which generating a vector includes generating a curve having a slope within one octant.

22. A method according to claim 16 including:

reading pixel value data along the vector in the frame buffer in accordance with said first and second words;

storing the pixel value data read from the frame buffer in an off-screen memory means;

writing new pixel value data along the vector in the frame buffer in accordance with said first and second words; and restoring the stored pixel value data from the off-screen memory means to the frame buffer by writing same along the vector in the frame buffer in accordance with said first and second words.

23. A method according to claim 16 in which the vector has an endpoint, including:

determining a magnitude of each of the X-axis and Y-axis components of the vector from beginning to end points;

determining which component is larger and designating that component as the major axis in the first word;

determining a sign of each of the X-axis and Y-axis components of the vector proceeding from beginning to end points and setting the direction of each in the first word; and determining the location of a second pixel along the vector and setting the minor axis bit in the second word depending on the second pixel's location relative to the major axis.

24. A raster scan image-generating system comprising:

graphic data generating means for generating graphic commands to define images for display;

raster scan display means for visually displaying the graphic data in a series of parallel raster lines, each line including a series of pixels;

processing means for translating the graphic commands into pixel data including an address and a value of each pixel;

frame buffer means including at least one plane of memory elements corresponding dimensionally to the raster lines and pixels of the display means for storing the pixel data and outputting the pixel data to the display means one raster line at a time and one pixel at a time in each line;

frame buffer control means connected to receive the pixel data from the processing means for controlling the manner in which the pixel data is stored in the frame buffer means;

means in the processing means for generating a vector having at least a beginning point and a direction and transmitting same to the frame buffer control means;

means in the frame buffer control means for generating frame buffer addresses in accordance with the vector;

off-screen memory means for storing portions of the graphic images;

means for reading pixel data from the frame buffer means and storing the pixel data in the off-screen memory means in accordance with the frame buffer addresses determined by the vector;

means in the processing means for encoding the vector in a first word and a second word, the first word including an address defined by the beginning point and a major and minor axis direction components, the second word including a minor axis bit defining a minor axis step; and addressing means in the frame buffer control means responsive to the first word to address the beginning point and set a direction of change of address for each axis, and responsive to each second word to incrementally change the major axis address and selectively responsive to the minor axis bit to incrementally change the minor axis address.

25. A system according to claim 24 in which the processing means and frame buffer means are configured as successive pipe stages in a pipeline along a bus means, each pipe stage including distributed first-in first-out (FIFO) means responsive to a clock signal for transmitting said words through a first, upstream pipe stage to a second, downstream pipe stage and responsive jointly to the clock signal and a hold signal from the downstream stage for holding said words until the hold signal is removed, and means responsive to the clock signal for pipelining the hold signals from the downstream pipe stage to the upstream pipe stage.

26. A method for operating a raster scan display system to display vector and vector-based graphic images, the system including a picture processor communicating with a frame buffer via a bus, the method comprising:

providing off-screen memory in communication with the picture processor;

generating graphic commands to define graphic images, including a graphic command for a vector having a beginning point and an endpoint;

processing the graphic commands into pixel data including a pixel address for a beginning point of the vector and means for defining subsequent pixel addresses along the vector;

addressing a series of memory locations in the frame buffer in accordance with the pixel addresses along the vector;

reading or writing a value of each pixel at each pixel address along the vector in the frame buffer;

transmitting the pixel values over the bus between the frame buffer and the picture processor for storage in the off-screen memory;

encoding the vector in a first word and a second word, the first word including an address defined by the beginning point and major and minor axis direction components of the vector, the second word including a minor axis bit defining a minor axis step;

in response to the first word, addressing the beginning point in the frame buffer and setting a direction of change of address for each axis; and in response to each second word, incrementally changing the major axis address in the direction set therefor and, in selective response to the minor axis bit, incrementally changing the minor axis address in the direction set therefor.

27. A method for operating a raster scan display system to display vector and vector-based graphic images, the system including a picture processor communicating with a frame buffer via a bus, the method comprising:

providing off-screen memory in communication with the picture processor;

generating graphic commands to define graphic images, including a graphic command for a vector having a beginning point and an endpoint;

processing the graphic commands into pixel data including a pixel address for a beginning point of the vector and means for defining subsequent pixel addresses along the vector;

addressing a series of memory locations in the frame buffer in accordance with the pixel addresses along the vector;

reading or writing a value of each pixel at each pixel address along the vector in the frame buffer;

transmitting the pixel values over the bus between the frame buffer and the picture processor for storage in the off-screen memory;

configuring the picture processor and frame buffer as a series of successive pipe stages in a pipeline along the bus;

providing at each pipe stage a distributed first-in first-out (FIFO) means responsive to a clock signal for transmitting said pixel data through a first, upstream pipe stage to a second, downstream pipe stage;

jointly controlling each pipe stage with the clock signal and a hold signal from the downstream stage for holding up operation of the pipe stage until the hold signal is removed;

pipelining the hold signals from the downstream pipe stage to the upstream pipe stage so that each upstream stage hold signal is controlled by the clock signal and is a logical OR of the hold signal from the downstream stage and of a busy signal from the upstream pipe stage; and controlling the FIFO of each upstream pipe stage with its respective pipe stage hold signal.

28. Apparatus for controlling a raster scan display for visually displaying the graphic data in a series of parallel raster lines, each line including a series of pixels, comprising:

processing means for transforming graphic commands into pixel data including an address and a value of each pixel;

frame buffer means for storing the pixel data and outputting the pixel data to the display one raster line at a time and one pixel at a time in each line;

bus means for transmitting pixel data between the processing means and the frame buffer means; and frame buffer control means connected to receive the pixel data from the processing means via the bus means for controlling the manner in which the pixel data is read or written in the frame buffer;

the processing means and frame buffer control means being configured as successive pipe stages in a pipeline along the bus means, each pipe stage including distributed first-in first-out (FIFO) means responsive to a clock signal for transmitting said pixel data through a first, upstream pipe stage to a second, downstream pipe stage and responsive jointly to the clock signal and a hold signal from the downstream stage for holding said pixel data until the hold signal is removed, and means responsive to the clock signal for pipelining the hold signals from the downstream pipe stage to the upstream pipe stage.

29. A system according to claim 28 including a Z buffer in communication with the bus means, the Z-buffer being configured as a pipe stage and including one of said FIFO means.

30. A system according to claim 28 including:

off-screen memory means in communication with the processing means for storing portions of the graphic images; and means for reading pixel data from the frame buffer means and transmitting same via the bus means to the processing means for storage into the off-display memory means;

the processing means and the frame buffer control means each including input and output sections configured as said pipes stages with said FIFO means.

31. A system according to claim 30 including means for restoring pixel data from the off-screen memory means to the frame buffer means via the bus means.

32. A system according to claim 28 which the but is a multiplexed address/data bus means for transmitting pixel data in the form of a first word including a pixel address in a first time interval and a second word including a pixel value between the processing means and the frame buffer means.

33. A system according to claim 32 in which the multiplexed address/data bus means is bidirectional for selectably writing pixel values from the processing means to the frame buffer means or reading pixel values from the frame buffer means to the processing means.

34. A method for transmitting graphic data in the form of pixel data including an address and a value of each pixel between a picture processor and a frame buffer in a raster scan display, the method comprising:

configuring the picture processor and frame buffer as a series of successive pipe stages in a pipeline along a bus;

providing at each pipe stage a distributed first-in first-out (FIFO) means responsive to a clock signal for transmitting said pixel data through a first, upstream pipe stage to a second, downstream pipe stage;

jointly controlling each pipe stage with a clock signal and a hold signal from the downstream stage for holding up operation of the pipe stage until the hold signal is removed;

pipelining the hold signals from the downstream pipe stage to the upstream pipe stage so that each upstream pipe stage hold signal is controlled by the clock signal and is a logical OR of the hold signal from the downstream stage and of a busy signal from the upstream pipe stage; and controlling the FIFO of each upstream pipe stage with its respective pipe stage hold signal.

35. A method according to claim 34 including:

generating a vector;

encoding the vector in the picture processor in a first word and a second word, the first word including an address defined by the beginning point and a major and minor axis direction components, the second word including a minor axis bit defining a minor axis step; and addressing the frame buffer in response to the first word to address the beginning point and setting a direction of change of address for each axis; and addressing the frame buffer in response to each second word by incrementally changing the major axis address and in selective response to the minor axis bit by incrementally changing the minor axis address.

* * * * *